US011036161B2

(12) United States Patent
Mukai et al.

(10) Patent No.: US 11,036,161 B2
(45) Date of Patent: Jun. 15, 2021

(54) DEVELOPER BEARING MEMBER, DEVELOPING APPARATUS, PROCESS CARTRIDGE, AND IMAGE FORMING APPARATUS

(71) Applicant: CANON KABUSHIKI KAISHA, Tokyo (JP)

(72) Inventors: Takashi Mukai, Kawasaki (JP); Takayuki Namiki, Yokohama (JP); Taichi Sato, Yokohama (JP); Yuki Yamamoto, Shiroi (JP); Kazunari Hagiwara, Yokohama (JP); Minoru Nakamura, Mishima (JP); Takahiro Kawamoto, Yokohama (JP); Yasukazu Ikami, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/849,277

(22) Filed: Apr. 15, 2020

(65) Prior Publication Data

US 2020/0333726 A1 Oct. 22, 2020

(30) Foreign Application Priority Data

Apr. 18, 2019 (JP) ..... JP2019-079338
Mar. 25, 2020 (JP) ..... JP2020-054720

(51) Int. Cl.
*G03G 15/08* (2006.01)
*G03G 21/18* (2006.01)

(52) U.S. Cl.
CPC ..... *G03G 15/0808* (2013.01); *G03G 15/0812* (2013.01); *G03G 21/1814* (2013.01)

(58) Field of Classification Search
None
See application file for complete search history.

(56) References Cited

U.S. PATENT DOCUMENTS 5,051,332 A 9/1991 Hosoya
6,389,253 B1 5/2002 Nonomura
(Continued)

FOREIGN PATENT DOCUMENTS

JP H04301663 A 10/1992
JP H117146 A 1/1999
(Continued)

OTHER PUBLICATIONS

Examination Report and Search Report issued in SG Application No. 10202003358P dated Nov. 4, 2020.
(Continued)

*Primary Examiner* — Jas A Sanghera
(74) *Attorney, Agent, or Firm* — Rossi, Kimms & McDowell LLP

(57) ABSTRACT

A developer bearing member including: a rotational shaft; and an elastic layer on an outer circumference surface of the rotational shaft, developer being borne on a surface of the elastic layer, wherein the elastic layer is configured such that a load per unit area of a contact portion between one surface of a flat glass plate and the surface of the elastic layer is to be 5.8 N/mm$^2$ or more, in a state that the one surface of the flat glass plate being parallel with an axis direction of the rotational shaft and the one surface of the flat glass plate coming into contact with the surface of the elastic layer with a predetermined penetration level, and wherein a ten-point average roughness Rzjis on the surface of the elastic layer is greater than a volume-average particle diameter of a particle of the developer.

29 Claims, 15 Drawing Sheets

(56) References Cited

U.S. PATENT DOCUMENTS

| | | | | |
|---|---|---|---|---|
| 6,397,032 | B1 | 5/2002 | Sakaizawa | |
| 8,103,199 | B2 | 1/2012 | Yasunaga | |
| 2001/0050706 | A1* | 12/2001 | Ishii | G03G 15/0855 347/254 |
| 2007/0059049 | A1* | 3/2007 | Onuma | G03G 15/0812 399/284 |
| 2007/0092702 | A1* | 4/2007 | Shimamura | G03G 15/0928 428/195.1 |
| 2007/0297834 | A1* | 12/2007 | Nishida | G03G 15/0812 399/284 |
| 2008/0175630 | A1 | 7/2008 | Yasunaga | |
| 2009/0208252 | A1* | 8/2009 | Nakagawa | G03G 15/0808 399/260 |
| 2015/0177653 | A1 | 6/2015 | Seki | |
| 2016/0252841 | A1* | 9/2016 | Goto | G03G 21/0064 399/55 |

FOREIGN PATENT DOCUMENTS

| | | | |
|---|---|---|---|
| JP | 3112489 | B2 | 11/2000 |
| JP | 2001066895 | A | 3/2001 |
| JP | 2002072544 | A | 3/2002 |
| JP | 2003162132 | A | 6/2003 |
| JP | 2013174628 | A | 9/2013 |
| RU | 2266553 | C2 | 12/2005 |
| RU | 2382390 | C2 | 2/2010 |
| RU | 2675200 | C1 | 12/2018 |

OTHER PUBLICATIONS

Extended European Search Report issued in European Appln. No. 20169825.5 dated Sep. 15, 2020.

Notice of Allowance issued in Russian Appln. No. 2020113720 dated Feb. 25, 2021. English translation provided.

* cited by examiner $$Vr = \frac{V2}{V1} \times 100$$

$$RSm = \frac{1}{N}\sum_{i=1}^{N} RSm_i$$

DEVELOPER BEARING MEMBER, DEVELOPING APPARATUS, PROCESS CARTRIDGE, AND IMAGE FORMING APPARATUS

BACKGROUND OF THE INVENTION

Field of the Invention

The present invention relates to an electrophotographic image forming apparatus that forms an image on a recording material.

Description of the Related Art

In an image forming apparatus, an electrostatic latent image formed on a surface of an image bearing member is developed by a developer on a developer bearing member whereby an image is formed. A configuration of a contact developing system in which an image is developed in a state in which the developer bearing member is in contact with the image bearing member is known. As the developer bearing member in such a configuration, a developing roller in which an elastic layer is formed on an outer circumferential surface of a core member which is rotated is generally used.

Moreover, the developing roller sometimes has an appropriate surface unevenness (roughness) due to reasons such as a developer conveying property and a charge-providing performance, and particles having an appropriate size are added as one of the means therefor. For example, as disclosed in Japanese Patent No. 3112489, a developing roller in which organic polymer compound particles having elasticity are contained in an elastic layer on the surface thereof so that very small unevenness is formed on the surface is known.

Moreover, in an image forming apparatus, since discharge occurs when an image bearing member is charged by a charging device, discharge products such as ozone or NOx adhere to the surface of the image bearing member. Since the surface of the image bearing member has a low surface friction coefficient μ and is hard, it is hard to scrape the surface and it is difficult to remove the discharge products adhering to the surface. When the discharge products adhering to the surface of the image bearing member absorb moisture, since the electric resistance of the surface of the image bearing member decreases, and the electric charge forming an electrostatic latent image is not retained, image smearing which is a phenomenon in which an image is blurred is likely to occur.

On the other hand, in order to achieve size reduction of an image forming apparatus and cost reduction with component saving, a so-called image-bearing-member-cleaner-less image forming apparatus in which a cleaning member for removing and collecting toner remaining on an image bearing member is not provided has been proposed. In such an image bearing member cleaner-less system, since the surface of the image bearing member is not scraped by a cleaning member, image smearing is particularly likely to occur. In order to solve this problem, Japanese Patent Application Publication No. 2003-162132 discloses a configuration in which image smearing is suppressed by changing a rotating speed of a charging device being in contact with an image bearing member to create a circumferential speed difference between the image bearing member and the charging device and scraping the surface of the image bearing member using the circumferential speed during a non-printing period.

SUMMARY OF THE INVENTION

However, the conventional examples have the following problems. In the following description, a contact pressure when the surface of a developing roller is pressed toward an image bearing member so that they make contact with each other will be referred to as a drum contact pressure. As a configuration in which the drum contact pressure is lowered, for example, a configuration in which an inter-shaft regulating member that regulates an inter-shaft distance between a developing roller and an image bearing member is provided at both ends of the developing roller to regulate a penetration level of the developing roller into the image bearing member is known. However, in such a configuration, the force of the developing roller scraping discharge products on the image bearing member weakens and image smearing is likely to occur. Particularly, in an image bearing member cleaner-less system, this problem is remarkable when an apparatus is placed under a high humidity environment. Therefore, a member for removing the discharge products as in the conventional example is necessary, the apparatus size and cost increase, and when the discharge products are removed, a removing operation needs to be performed frequently, which decreases the user's convenience.

The present invention has been made in view of these problems. That is, an object of the present invention is to suppress occurrence of image smearing without decreasing the user's convenience to obtain satisfactory image quality stably with a simple configuration.

With a view to attaining the above goal, a developer bearing member of the present invention has:

a rotational shaft; and an elastic layer formed on an outer circumference surface of the rotational shaft, developer being borne on a surface of the elastic layer, wherein the elastic layer is configured such that, a load per unit area of a contact portion between one surface of a flat glass plate and the surface of the elastic layer is to be 5.8 $N/mm^2$ or more, in a state that the one surface of the flat glass plate being parallel with an axis direction of the rotational shaft and the one surface of the flat glass plate coming into contact with the surface of the elastic layer with a predetermined penetration level, and wherein a ten-point average roughness Rzjis on the surface of the elastic layer is greater than a volume-average particle diameter of a particle of the developer.

With a view to attaining the above goal, a developing apparatus of the present invention has:

above mentioned developer bearing member for supplying developer to an image bearing member for bearing an image; and a regulating member for regulating a thickness of the developer borne by the developer bearing member, the developer bearing member including:

a rotational shaft; and an elastic layer formed on an outer circumference surface of the rotational shaft, developer being borne on a surface of the elastic layer, wherein the elastic layer is configured such that a load per unit area of a contact portion between one surface of a flat glass plate and the surface of the elastic layer is to be 5.8 $N/mm^2$ or more, in a state that the one surface of the flat glass plate being parallel with an axis direction of the rotational shaft and the one surface of the flat glass plate coming into contact with the surface of the elastic layer with a predetermined penetration level, and wherein a ten-point average roughness Rzjis on the surface of the elastic layer is greater than a volume-average particle diameter of a particle of the developer.

With a view to attaining the above goal, a process cartridge of the present invention has:

above mentioned developer bearing member or above mentioned developing apparatus, and an image bearing member for bearing an image, wherein the process cartridge is detachably attached to a main body of an image forming apparatus.

With a view to attaining the above goal, an image forming apparatus of the present invention has:

above mentioned developer bearing member, or above mentioned developing apparatus, or above mentioned process cartridge; and a transfer member, wherein the developer bearing member is provided so as to contact with the image bearing member with the predetermined penetration level.

According to the present invention, it is possible to suppress occurrence of image smearing without decreasing the user's convenience to obtain satisfactory image quality stably with a simple configuration.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Overview of Image Forming Apparatus

Figure 1:
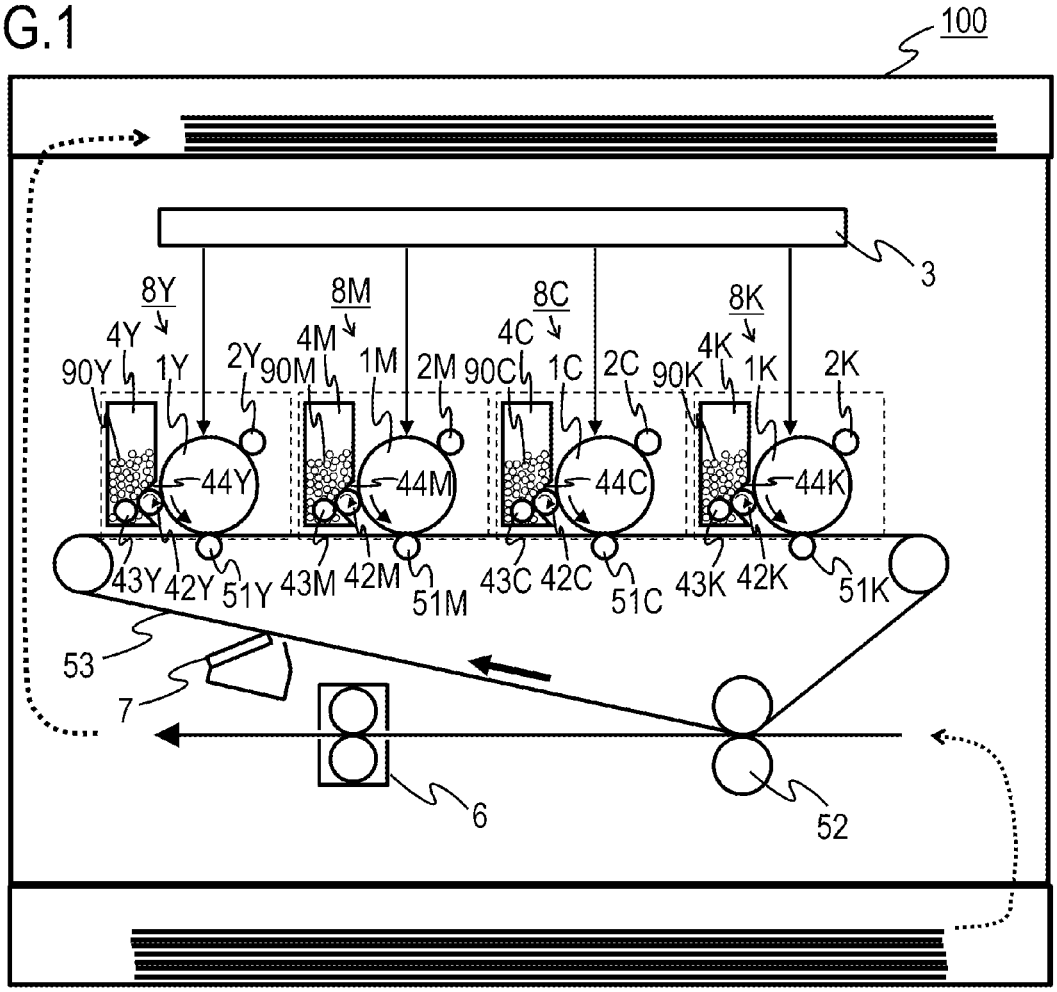
FIG. 1 is a schematic diagram illustrating an example of an image forming apparatus according to Embodiment 1.

An overall configuration and an image forming operation of an electrophotographic image forming apparatus (hereinafter, an image forming apparatus) according to Embodiment 1 of the present invention will be described with reference to FIG. 1. FIG. 1 is a schematic cross-sectional view illustrating a schematic configuration of an image forming apparatus 100 according to an embodiment of the present invention.

In the present embodiment, image forming stations of the four colors of yellow, magenta, cyan, and black are arranged in that order from left to right on the drawing. The image forming stations are electrophotographic image forming mechanisms having a similar configuration except that the colors of developer (hereinafter toner) 90 stored in respective developing apparatuses are different. In the following description, when particular distinction is not necessary, the subscripts Y (yellow), M (magenta), C (cyan), and K (black) added to the reference numerals to indicate the color of the corresponding component will be omitted, and the image forming stations will be described collectively.

Each image forming station includes, as its main configuration, a photosensitive drum 1 as an image bearing member, a charging roller 2 as a charging device, an exposure apparatus 3, a developing apparatus 4, and a primary transfer unit 51. In the present embodiment, the photosensitive drum 1, the charging roller 2, and the developing apparatus 4 are integrated as a process cartridge 8, which is detachably attached to a main body of an image forming apparatus (a portion of the image forming apparatus 100 excluding the process cartridge 8). However, in the present invention, the process cartridge may be a cartridge which includes at least the photosensitive drum 1 and the developing apparatus 4 and which is detachably attached to the main body. Moreover, only the developing apparatus 4 may be detachably attached to the main body or the process cartridge 8. Moreover, the photosensitive drum 1 and the developing apparatus 4 may be attached to the main body of an image forming apparatus so that replacement by a user is not necessary.

The photosensitive drum 1 is a cylindrical photosensitive member and rotates in a counter-clockwise direction indicated by an arrow about a shaft thereof. In the present embodiment, an outer circumferential surface of the photosensitive drum 1 is rotated at a speed of 100 mm/sec. The surface of the photosensitive drum 1 is uniformly charged by the charging roller 2. In the present embodiment, the charging roller 2 is a conductive roller in which a conductive rubber layer is formed on a core and which is arranged in parallel with the photosensitive drum 1 with a prescribed contact pressure so as to rotate following the rotation of the photosensitive drum 1. In the present embodiment, the photosensitive drum 1 is charged by applying a DC voltage of −1,100 V to the charging roller 2 so that the surface potential of the photosensitive drum 1 is approximately −550 V. An electrostatic latent image corresponding to an image signal is formed on the charged photosensitive drum 1 by the exposing unit 3.

The developing apparatus 4 supplies the toner 90 to the electrostatic latent image on the photosensitive drum 1 so that the electrostatic latent image is visualized as a toner image. In the present example, the developing apparatus 4 is a contact-developing-type reverse developing apparatus that contains the toner 90 as one-component developer having a negative normal charging polarity (a charging polarity for developing an electrostatic latent image).

The developing apparatus 4 includes a developing roller 42 as a developer bearing member, a toner supply roller 43, and a regulating blade 44 as a developer regulating member. The toner supply roller 43 is an elastic sponge roller having a foam layer on an outer circumference of a conductive core. The toner supply roller 43 is arranged to make contact with the developing roller 42 with a prescribed penetration level. The toner 90 supplied by the toner supply roller 43 and held on the developing roller 42 is regulated by the regulating blade 44 to form a thin layer of toner which is provided for development. Here, the regulating blade 44 has a function of regulating the layer thickness of the toner 90 on the developing roller 42 and a function as a developer charging device that applies prescribed charge to the toner 90 on the developing roller 42.

The developing roller 42 is rotated in a direction indicated by an arrow in FIG. 1 so that the moving direction of the surface thereof is the same as the moving direction of the photosensitive drum 1. In the present example, in order to obtain an appropriate image density, the developing roller 42 is rotated so that the moving speed of the surface is 140% of the moving speed of the surface of the photosensitive drum 1. The developing apparatus 4 is pressed toward the photosensitive drum 1 by an urge member (not illustrated), and as a result, the developing roller 42 is pressed against the photosensitive drum 1. In this way, the surface of the developing roller 42 is deformed to form a developing nip, whereby stable development can be performed in a stable contact state.

The toner image formed on the photosensitive drum 1 is electrostatically transferred to an intermediate transfer belt 53 by a primary transfer unit 51 which is one of transfer members. The toner images of the respective colors are sequentially superimposed on and transferred to the intermediate transfer belt 53 whereby a full-color toner image is formed. The full-color toner image is transferred to a recording material by a secondary transfer unit 52 which is a transfer member different from the primary transfer unit 51. After that, the toner image on the recording material is pressurized and heated by a fixing apparatus 6 and is fixed to the recording material, and the recording material is discharged as a printed material.

Moreover, a belt cleaning apparatus 7 is disposed on the downstream side of the secondary transfer unit 52 in the moving direction of the intermediate transfer belt 53 so that the toner 90 remaining on the intermediate transfer belt 53 is removed and collected.

The present example employs an image bearing member cleaner-less system in which a dedicated cleaner apparatus is not provided in the photosensitive drum 1. No member makes contact with the surface of the photosensitive drum 1 until the surface of the photosensitive drum 1 having passed through an opposing position (a primary transfer position) of the primary transfer unit 51 reaches a contact position (a charging position) with the charging roller 2. In this way, when the developing roller 42 of the developing apparatus 4 is brought into contact with the photosensitive drum 1, the toner 90 remaining on the photosensitive drum 1 can be collected into the developing apparatus 4 after printing is performed. However, a configuration for obtaining the effects of the present invention is not limited to the above-described configuration.

Contact Configuration between Developing Roller and Photosensitive Drum

Figure 2A:
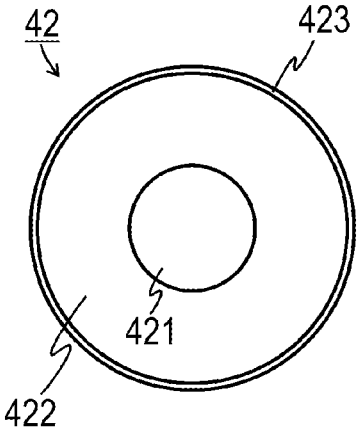
FIGS. 2A and 2B are a schematic cross-sectional view and an enlarged cross-sectional view of a developing roller according to Embodiment 1.
Figure 2B:
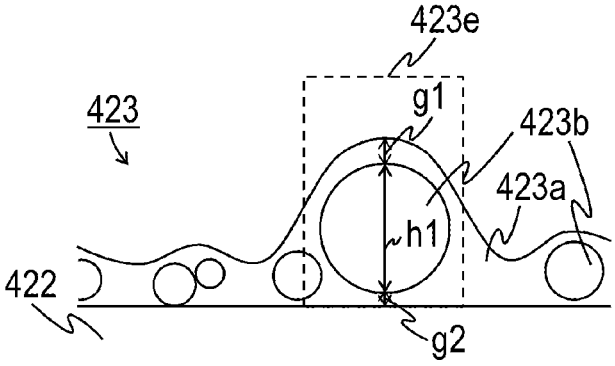

Next, the developing roller 42 according to the present invention and a surface layer 423 thereof will be described. FIG. 2A is a schematic cross-sectional view illustrating a schematic configuration of the developing roller 42 according to the present example and is a cross-sectional view when seen from a rotation axis direction of the developing roller 42. FIG. 2B is a schematic cross-sectional view illustrating the surface layer 423 of the developing roller 42 according to the present example in an enlarged scale.

As illustrated in FIG. 2A, the developing roller 42 is a rubber roller in which an elastic layer having elasticity including a base layer 422 and a surface layer 423 is formed on an outer circumference of a shaft core 421 formed using a conductive member such as metal and the surface of the surface layer 423 makes contact with the photosensitive drum 1. As illustrated in FIG. 2B, the surface layer 423 contains a surface layer binder resin 423*a* and coarse particles 423*b* as coarse members distributed in the surface layer binder resin 423*a*. In this way, a plurality of protrusions is formed on the surface of the surface layer 423. In the present invention, the surface layer binder resin 423*a* and the coarse particles 423*b* are selected so as to satisfy the range of compressive elastic modulus.

Moreover, the length of the surface layer 423 of the developing roller 42 in a longitudinal direction parallel to the rotation axis thereof is 235 mm in the present embodiment and is set to be shorter than the length in the longitudinal direction parallel to the rotation axis of the photosensitive drum 1.

The developing roller 42 is rotatably supported by the developing apparatus 4 via a portion through which the shaft core 421 is exposed. An inter-shaft regulating member 45 (not illustrated) is provided in a portion of both ends of the developing roller 42 through which the shaft core 421 is exposed. The inter-shaft regulating member 45 is a member having such a thickness that the distance between the shaft core 421 and the photosensitive drum 1 is regulated.

Figure 3:
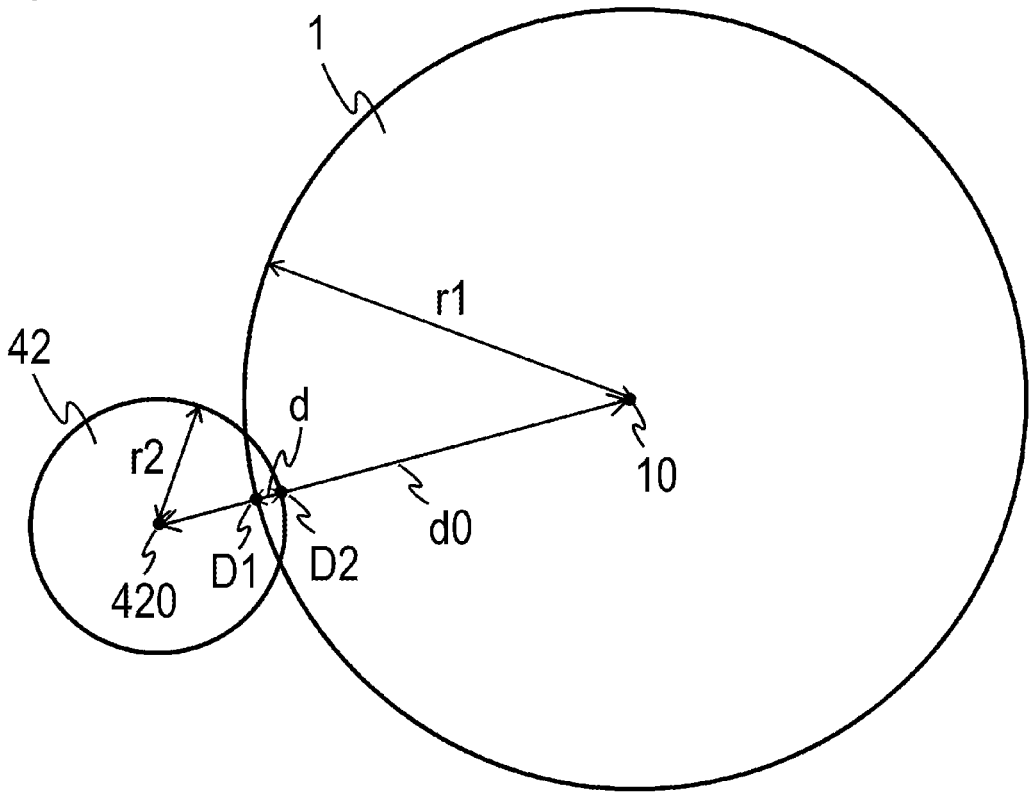
FIG. 3 is a cross-sectional view illustrating a penetration level between a developing roller and a photosensitive drum.

Here, a penetration level d of the developing roller 42 to the photosensitive drum 1 will be described with reference to FIG. 3. FIG. 3 is a schematic cross-sectional view illustrating a state in which the photosensitive drum 1 and the developing roller 42 are in contact with each other during a printing period, when seen from the rotation axis direction of the developing roller 42. An outer circumference shape of the photosensitive drum 1 is a circle having a radius of r1 and an outer circumference shape of the developing roller 42 is a circle having a radius of r2. An inter-shaft distance d0 is the distance between the center of rotation 10 of the photosensitive drum 1 and the center of rotation 420 of the developing roller 42 in a state in which the developing roller 42 and the photosensitive drum 1 are in contact with each other for printing. Moreover, contacts D1 and D2 are the contacts between the circles having the radii of r1 and r2, respectively, which are the outer circumferential surfaces on the line connecting the centers of rotation 10 and 420 when it is assumed that the photosensitive drum 1 and the developing roller 42 are not deformed by contacting. The distance between the contacts D1 and D2 is defined as a penetration level d. In this case, the penetration level d can be represented by Equation 1 below using the radius r1 of the photosensitive drum 1, the radius r2 of the developing roller 42, and the inter-shaft distance d0 and can be calculated.

$$d=r1+r2-d0 \quad \text{(Equation1)}$$

The radii r1 and r2 are measured using a full-automatic roller measurement system RVS-860-3C/S4 (product of Tokyo Opto-Electronics Co., Ltd.). In the present embodiment, r1 is 10.00 mm and r2 is 5.00 mm.

The penetration level d can be adjusted by adjusting the thickness of the inter-shaft regulating member 45 from the side of the shaft core 421 toward the side of the photosensitive drum 1. For example, when the penetration level d is set to 0.04 mm, since the distance between the center of rotation 420 and the contact D1, which is a subtraction of the radius r1 from the inter-shaft distance d0, may be 4.96 mm on the basis of Equation 1, the thickness of the inter-shaft regulating member 45 is set to a value obtained by subtracting the radius of the shaft core 421 from 4.96 mm.

Here, since the developing roller 42 is deformed in the process of making contact with the photosensitive drum 1, a pressing force is generated due to a repulsive force. In the following description, a load per unit length in the longitudinal direction, acting between the developing roller 42 and the photosensitive drum 1 will be referred to a drum contact pressure P. The drum contact pressure P is a value determined by components and the penetration level d including the compressive elastic modulus of the components of the developing roller 42. If the developing rollers 42 have the same configuration, the larger the penetration level d, the greater the repulsive force and the larger the drum contact pressure P. Therefore, in order to adjust the drum contact pressure P of the developing roller 42 to a prescribed value, the penetration level d is adjusted by the above-described method.

In the present example, since the penetration level d is regulated by the inter-shaft regulating member 45, the drum contact pressure P does not increase more than necessary.

In the present example, the penetration level d is set such that the drum contact pressure P is 7.7 N/m or more. In this way, a developing nip having an appropriate width is formed and stable printing is performed. Moreover, a contact pressure U which is a force for scraping discharge products on the photosensitive drum 1 with the surface of the developing roller 42 is formed and the effect of suppressing image smearing is obtained.

Surface Shape of Developing Roller

Although a layer of the toner 90 is formed on the surface of the developing roller 42, the toner in a higher-thickness portion of the surface (a portion protruding toward the photosensitive drum 1) is likely to be scraped and dropped when passing through a contact region contacting the regulating blade 44 or the photosensitive drum 1. Since such a protrusion exceeds the height of the toner 90, the protrusion can make contact with the photosensitive drum 1 without the toner 90 disposed therebetween. As a result, the discharge products on the photosensitive drum 1 are likely to be scraped by the developing roller 42.

Therefore, in the present invention, the ten-point average roughness Rzjis of the surface of the developing roller 42 is greater than a volume-average particle diameter of the toner 90 so that the discharge products are easily scraped and image smearing can be suppressed.

In the present invention, the ten-point average roughness Rzjis of the developing roller 42 can be measured using a contact surface roughness measuring instrument Surfcorder SE3500 (product of Kosaka Laboratory Ltd.), for example. As measurement conditions, a cut off value was 0.8 mm, the measurement length was 2.5 mm, and a feeding speed was 0.1 mm/sec. Arbitrary three positions different in the longitudinal direction was measured for one developing roller, and the average value of the obtained measurement values was used as Rzjis of the developing roller 42.

A volume-average particle diameter of the toner 90 can be calculated using the measurement values measured by the following measurement method. A coulter multisizer IV (product of Beckman Coulter, Inc.) was used as a measuring device. As an electrolytic solution, a solution (for example, ISOTON II (product of Beckman Coulter, Inc.)) in which a special grade sodium chloride is dissolved in an ion-exchange water to a concentration of approximately 1% by mass can be used. As a measurement method, 0.5 ml of an alkylbenzene sulfonate is added as a dispersing agent to 100 ml of an aqueous electrolytic solution, and 10 mg of a measurement sample is further added. The electrolytic solution in which the measurement sample is suspended is subjected to a dispersion treatment for 1 minute by an ultrasonic disperser, and the volume particle size distribution is measured by a measuring device using a 30-μm aperture, and the measured median diameter (D50) is used as a volume-average particle diameter. In the present example, the volume-average particle diameter of the toner 90 is 7 μm whereas the ten-point average roughness Rzjis of the surface of the developing roller 42 is 10 μm.

In the present example, the volume-average particle diameter of the coarse particles 423*b* was greater than the volume-average particle diameter of the toner 90. For example, the volume-average particle diameter of the toner 90 is 7 μm whereas the ten-point average roughness Rzjis of the surface of the developing roller 42 is 10 μm. By doing so, the Rzjis of the surface of the surface layer 423 can be easily made greater than that of the toner 90. However, in order to obtain the effects of the present invention, the ten-point average roughness Rzjis of the surface of the developing roller 42 may be greater than the volume-average particle diameter of the toner 90, and the volume-average particle diameter of the coarse particles 423*b* may be smaller than the volume-average particle diameter of the toner 90. For example, the Rzjis of the surface of the surface layer 423 may be greater than that of the toner 90 by increasing an insertion amount of the coarse particles 423*b* with respect to the surface layer binder resin 423*a* regardless of the particle size of the coarse particle 423*b*.

Contact Area S and Contact Pressure U

Next, a method of measuring the contact area S and the contact pressure U between the developing roller 42 and the flat glass plate I which is the feature of the present invention will be described with reference to FIGS. 4A and 4B. Here, the contact area S and the contact pressure U are the area and the pressure of a very small portion of the developing roller 42 making contact with the photosensitive drum 1, measured using the flat glass plate I which is a transparent rigid flat plate instead of the photosensitive drum 1. Since the value of the contact area S ($mm^2$) is the area of a very small portion contacting the region of a developing nip having a unit area of 1 $mm^2$, the contact area S has the meaning of an area ratio of the contacting very small portion.

Figure 4A:
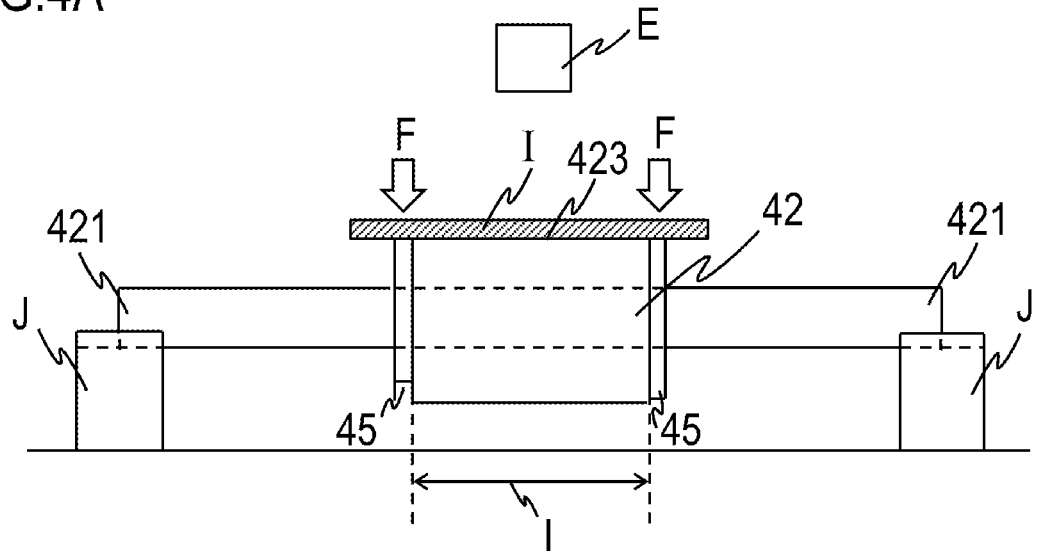
FIGS. 4A and 4B are diagrams illustrating a measurement method in a contact portion between a developing roller and a flat glass plate.

FIG. 4A is a diagram illustrating a configuration for measuring the contact area S and the contact pressure U.

First, a method of measuring the contact area S will be described. The shaft core 421 of the developing roller 42 is placed on a fixed portion J in which the heights on the stage of a microscope E are equal so that the developing roller 42 is supported in a state in which the lower surface of the surface layer 423 is not in contact with the stage of the microscope E. Moreover, the developing roller 42 is supported so that the rotation axis of the developing roller 42 is vertical to the direction of gravity. The transparent rigid flat glass plate I parallel to the rotation axis of the developing roller 42 is pressed toward the surface layer 423 of the developing roller 42. The thickness of the flat glass plate I may be set to 1 mm to 5 mm, for example, within a range in which cracks or the like do not occur during pressing and the flat glass plate I does not interfere with the lens of the microscope E. In the present example, the flat glass plate I has a thickness of 1 mm. Moreover, the flat glass plate I has a smooth surface and is sufficiently cleaned so that an observation image to be described later is acquired appropriately.

In the present example, measurement was performed while restricting the region of the developing roller 42 making contact with the flat glass plate I to a portion in the longitudinal direction thereof. More specifically, the base layer 422 and the surface layer 423 of the developing roller 42 are removed from the shaft core 421 while leaving a portion in the longitudinal direction which makes contact with the flat glass plate I and in which the contact area S is measured. The measurement may be performed by bringing the flat glass plate I into contact with the entire region of the developing roller 42 without removing the base layer 422 and the surface layer 423. Here, the length in the longitudinal direction of the portion where the base layer 422 and the surface layer 423 of the developing roller 42 are present, with which the flat glass plate I is brought into contact is a length 1. In the present example, the contact area S, the drum contact pressure P to be described later, and the contact pressure U were measured by setting the length 1 to 50 mm.

In this case, the inter-shaft regulating member 45 is provided at both ends of the shaft core 421 exposed to both ends of the portion where the base layer 422 and the surface layer 423 of the developing roller 42 are present. The flat glass plate I has such a size that it can make contact with the portion having the length 1 in the longitudinal direction of the developing roller 42, where the base layer 422 and the surface layer 423 are present and the inter-shaft regulating member 45 at both ends. With this configuration, the developing roller 42 can make contact with the flat glass plate I with the same penetration level d as the penetration level d with respect to the photosensitive drum 1. Moreover, the same load F is applied to portions near the inter-shaft regulating members 45 at both ends in a vertical direction toward the rotation axis of the developing roller 42 so that the flat glass plate I is equally pressed against the developing roller 42. In this case, a load F0 corresponding to the weight of the flat glass plate I as well as the load 2F pressed from above the flat glass plate I is also applied to the entire developing roller 42 and the entire inter-shaft regulating members 45 at both ends.

The load F when measuring the contact area S needs to have a magnitude for making contact with the penetration level d. In the present example, when the contact area S is measured, the load F was set to 5N larger than a minimum load F1 to be described later on both sides so that the inter-shaft regulating member 45 makes contact with the flat glass plate I with the penetration level d. When the contact area S is measured, the penetration level between the developing roller 42 and the flat glass plate I may be the same as the penetration level d when the developing roller 42 makes contact with the photosensitive drum 1. Therefore, the load F mentioned herein is not necessarily identical to the load of a pressing force acting between the developing roller 42, the inter-shaft regulating member 45, and the photosensitive drum 1.

A contact state between the developing roller 42 and the flat glass plate I is observed using the microscope E capable of observing the state from a direction vertical to the flat glass plate I. A laser microscope VK-X200 (product of Keyence Corporation) or the like can be used as the microscope E. During observation, a surface of the flat glass plate I being in contact with the developing roller 42 is focused on. In the present example, observation was performed under a magnification condition of 200 times. Moreover, the brightness condition during observation was set to 128 which is a median value between 0 corresponding to an entirely black image and 255 corresponding to an entirely white image.

Figure 4B:
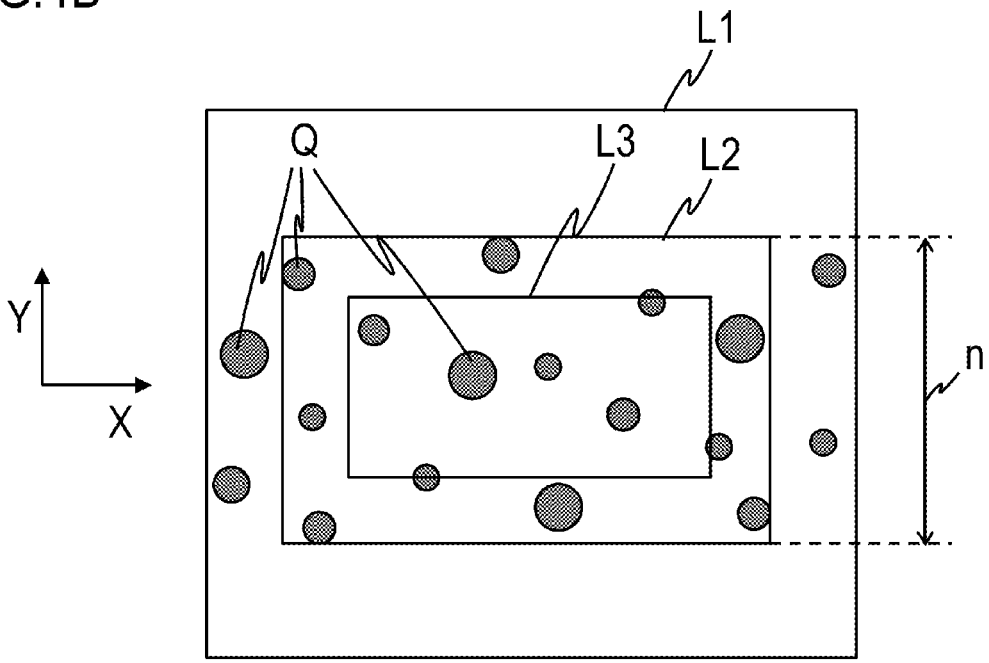

FIG. 4B is a diagram illustrating a partial contact state when the contact portion was observed by the above-described method. An X-direction in the drawing is a direction parallel to the rotation axis of the developing roller 42, and a Y-direction is a direction vertical to the X-direction. A contact portion Q which is in partial contact is seen in an observation region L1 observable by the microscope E. Portions other than the contact portion Q in the observation region L1 are portions in which the developing roller 42 is not in contact with the flat glass plate I. The contact portion Q includes a plurality of isolated partial regions in the observation region L1, reflectivity of light decreases in the contact portion Q, the contact portion Q appears dark on an observation image. The observation region L1 is observed so that all contact portions Q in which the flat glass plate I and the developing roller 42 are in contact with each other are included in the Y-direction. However, it is not necessary to include all contact portions Q in the X-direction. Here, the observation region L1 may be observed by combining a plurality of observation images and moving a positional relationship between the developing roller 42 and the lens of the microscope E.

In order to determine a region in which the contact area S is measured, a contact region L2 as a region in which a developing nip is formed is defined in the following manner. The contact region L2 is a rectangular region having an area of 1 $mm^2$ or more in which the contact portion Q is included in the four sides thereof and is determined such that the width in the Y-direction of the contact region L2 is maximized. That is, the contact region L2 is defined as a rectangular region having the upper side in which the uppermost end in the Y-direction of all contact portions Q in the observation region L1 is included and the lower side in which the lowermost end in the Y-direction is included. The width in the Y-direction of the contact region L2 is a nip width n.

The contact area S which is the sum of the areas of all contact portions Q in the measurement region L3 having the area of 1 $mm^2$ selected from the contact region L2 is measured. Here, the measurement region L3 is a region having a shape symmetrical in the Y-direction about the center position in the Y-direction, located at a position facing the rotation axis of the developing roller 42. A region located as close as possible to the center of an observation image in which light intensity can be detected stably is preferably selected as the measurement region L3. The measurement region L3 is a rectangular region having a Y-direction width of 0.5 mm and an X-direction width of 2.0 mm about the center position in the Y-direction, located at the center position in the Y-direction of the contact region L2, which can be regarded as being equivalent to the position facing the rotation axis of the developing roller 42 so that the measurement region L3 is included in the contact region L2, for example. The shape of the measurement region L3 may be a region having an area of 1 $mm^2$, and there is no limitation to such a selection method. As an example of a method of calculating the contact area S from an observation image, binarization analysis may be used.

In binarization analysis, image processing (binarization) is performed so that the contact portion Q corresponds to a black part and a non-contact portion other than the contact portion Q corresponds to a white part. Hereinafter, a binarization analysis method using image processing software ImageJ (developed by Wayne Rasband (NIH), Ver. 1.52d), which is used in the present example, will be described. The contact area S can be also calculated using other image analysis software with which binarization analysis can be performed. First, an observation image is cut out so that the measurement region L3 is included in the image and regions other than the contact region L2 are not included, and the cut image is converted to a 32-bit grayscale image. A Yen algorithm is selected as an automatic threshold setting method and a binarization threshold level is set automatically so that the contact portion Q match the range of a black part after binarization. The area of all contact portions Q in the measurement region L3 converted to black parts is calculated in the number of pixels, and a value obtained by dividing the calculated area (number of pixels) by a total number of pixels of the measurement region L3 is calculated as the contact area S ($mm^2$) per unit area.

Next, a method of measuring the drum contact pressure P necessary for calculating the contact pressure U will be described. The drum contact pressure P is a load per unit length in the longitudinal direction when the developing roller 42 makes contact with the photosensitive drum 1, and the drum contact pressure P can be measured using the flat glass plate I instead of the photosensitive drum 1. The drum contact pressure P can be measured in the following manner using the same measurement configuration of FIG. 4A as used for measurement of the contact area S. First, the load F is gradually increased in a state of a zero load F from a state in which the flat glass plate I is not in contact with the inter-shaft regulating member 45. The load when the flat glass plate I makes contact with both inter-shaft regulating members 45 at both sides is measured as F1. In this way, a minimum load F1 for making contact with the penetration level d can be known. Here, a total load (2F1+F0) obtained by adding the load 2F1 applied to both ends and the own weight F0 of the flat glass plate I is equal to the load applied to the developing roller 42 only when the flat glass plate I is in contact with the inter-shaft regulating members 45 at both ends. Therefore, the drum contact pressure P (N/m) is represented by Equation 2 below using the minimum load F1 (N), the own weight F0 (N) of the flat glass plate I, and the length 1 (mm) in the longitudinal direction and can be measured.

$$P=(2F1+F0)/(1\times10^{-3}) \quad \text{(Equation 2)}$$

A correlation between the drum contact pressure P and the penetration level d is determined by a configuration such as a hardness or a shape of the developing roller 42, and the correlation is such that the larger the penetration level d, the larger becomes the drum contact pressure P. Moreover, when a load F equal to or larger than the minimum load F1 is applied similarly to the measurement of the contact area S, the penetration level d is determined by the inter-shaft regulating member 45, and the flat glass plate I is in contact with the developing roller 42 with a drum contact pressure P corresponding to the penetration level d.

The contact pressure U ($N/mm^2$) is a load (pressure) per unit area applied to the contact portion Q only, and is represented as Equation 3 below using the drum contact pressure P (N/m), the contact area S ($mm^2$), and the nip width n (mm).

$$U=P/(10^3\times S\times n) \quad \text{(Equation 3)}$$

Based on Equation 3, the contact pressure U can be calculated from the measurement values of the contact area S, the nip width n, and the drum contact pressure P. In the present example, the contact pressure U is set to 5.8 $N/mm^2$ or more so that occurrence of image smearing can be suppressed.

Here, the reason why image smearing can be suppressed by increasing the contact pressure U will be described. Image smearing occurs because discharge products adhering to and accumulating on the photosensitive drum 1 due to discharge or the like from the charging roller 2 are not removed appropriately. Therefore, by decreasing the contact area S which is the area of a portion of the developing roller 42 protruding more than the toner 90, which makes contact with the photosensitive drum 1, the contact pressure U which is the pressure of the contact portion is further increased (that is, the developing roller 42 makes contact with the photosensitive drum 1 partially more strongly). In this way, since the discharge products on the photosensitive drum 1 are scraped and decreased, it is possible to suppress image smearing.

Compressive Elastic Modulus R of Surface Layer of Developing Roller

Next, the compressive elastic modulus R of the surface layer 423 of the developing roller 42 for obtaining the contact pressure U of the present invention will be described. A compressive elastic modulus is defined by a division of a pressure applied during crushing by a compression ratio of a height compressed during crushing. In the following description, an elastic modulus refers to an elastic modulus in such a compression direction.

the elastic modulus R (hereinafter, referred to simply as the elastic modulus R of the surface layer 423) in the contact portion Q which is a very small portion of the surface layer 423 making contact with the photosensitive drum 1 can be measured in the following manner. First, a method of measuring a compressive elastic modulus A of the surface layer binder resin 423*a* of the surface layer 423 and a compressive elastic modulus B of the coarse particle 423*b* of the surface layer 423, for calculating the elastic modulus R of the surface layer 423 will be described. As values used in description of the present example, a rubber piece of the developing roller 42 was cut out and the elastic moduli of the coarse particle 423*b* and the surface layer binder resin 423*a* were measured using SPM (product name: MFP-3D-Origin, product of Oxford Instruments Corporation). The details of the measurement method will be described later.

First, a thin rubber piece having a thickness of 200 nm and a size of 100 μm×100 μm, including a cross-section of the surface layer 423 of the developing roller 42 is cut out at a temperature of 150° C. using Cryomicrotome (UC-6 (product name), product of Leica Microsystems Corporation). The thin rubber piece was loaded on a smooth silicon wafer and was left for 24 hours under an environment of a room temperature of 25° C. and a humidity of 50%. Subsequently, the silicon wafer having the thin rubber piece loaded thereon was set on a SPM stage and the cross-section of the surface layer 423 was observed using a SPM. Moreover, a spring constant and an impulse constant of a probe (product name: AC160, product of Olympus Corporation) were equal to or smaller than prescribed constants in a thermal noise method using a SPM device (spring constant: 28.23 nN/nm and impulse constant: 82.59 nm/V). Moreover, the probe was tuned in advance and the resonance frequency of the probe was obtained (282 KHz (first-order) and 1.59 MHz (high-order)). The SPM measurement mode was an AM-FM mode, a free amplitude of the probe was 3V, and a set point amplitude was 2 V (first-order) and 25 mV (high-order). Scanning was performed in a view field size of 5 μm×5 μm under conditions that a scanning speed was 1 Hz (a reciprocating speed of a probe) and the number of scan points was 256 (vertical) by 256 (horizontal) points and a height image and a phase image were acquired simultaneously.

Subsequently, portions of the obtained image where the elastic modulus is to be measured by force curve measurement were designated. That is, 20 points of the portion of the surface layer binder resin 423*a* and 20 points of the portion of the coarse particles 423*b* were designated. After that, a force curve measurement was performed in a contact mode once for all points. A force curve was acquired under the following conditions. In force curve measurement, measurement is performed by performing control such that a Z-piezo position approaches a sample surface and the probe folds back when a deflection of the probe reaches a prescribed value. In this case, the fold-back point is referred to as a trigger value and indicates when the probe folds back how much the voltage V was increased from a deflection voltage at the start of the force curve. In this measurement, measurement was performed in a range of trigger values of 0.2 to 0.5 V. A trigger value of 0.2 V was used for low-hardness samples since a sufficient push depth is secured by deflecting a sprint just a little. A trigger value of 0.5 V was used for high-hardness samples since it is necessary to deflect a spring greatly in order to secure a push depth. As the other force curve measurement conditions, a measurement distance after folding-back at the trigger value was 500 nm and a scan speed was 1 Hz (a reciprocating speed of a probe).

Subsequently, fitting based on the Hertz theory was performed for each of the obtained force curves and elastic moduli were calculated. Here, the average value of the elastic moduli calculated from twenty force curves measured in the portion of the surface layer binder resin 423*a* was used as the compressive elastic modulus A of the surface layer binder resin 423*a*. Furthermore, the average value of the elastic moduli calculated from twenty force curves measured in the portion of the coarse particles 423*b* was used as the compressive elastic modulus B of the coarse particles 423*b*.

Here, in the present invention, a thickness ratio e for calculating the elastic modulus R of the surface layer 423 is defined as below. In the contact portion Q which is a very small portion in which the developing roller 42 makes contact with the photosensitive drum 1, a ratio of a layer thickness h (m) of the coarse particles 423*b* to a layer thickness g (μm) of the surface layer binder resin 423*a* in a direction orthogonal to the axial direction of the developing roller 42 is a thickness ratio e. The thickness ratio e is represented by Equation 4 below.

$$e=h/g \quad \text{(Equation 4)}$$

The thickness ratio e can be calculated by cutting the surface layer 423 and observing the cross-section thereof. For example, a case in which the observation result is such a cross-sectional shape as in FIG. 2B will be described. Since the volume-average particle diameter of the developing roller 42 making contact with the photosensitive drum 1 is a vertex portion of the surface profile height, the thicknesses g1, g2, and h1 of the vertex portion are measured. The layer thickness g of the surface layer binder resin 423*a* is the sum of the thickness g1 of an upper part of a coarse particle and the thickness g2 of a lower part of a coarse particle, and the layer thickness h of the coarse particle 423*b* is the thickness (particle diameter) h1 of the coarse particle only. When a plurality of coarse particles 423*b* is present in the vertex portion, the layer thickness h is the sum of the thicknesses (particle diameter) of the respective coarse particles 423*b*. In the present example, the thickness ratio e was approximately 7. Although the effects of the present invention are obtained by adjusting the value of the elastic modulus R of the surface layer 423 to be described later, there is no limitation to the thickness ratio e.

How an equation for calculating the elastic modulus R of the surface layer 423 is derived will be described below. In this example, an amount of the very small portion of the surface layer 423 making contact with the photosensitive drum 1, the very small portion being crushed by the contact will be considered.

Since the very small portion of the surface layer 423 making contact with the photosensitive drum 1 is a protrusion including the coarse particle 423*b*, the very small portion is regarded as a layer structure in which the portion of the surface layer binder resin 423*a* and the portion of the coarse particle 423*b* overlap each other. The contact pressure U is applied to the very small portion. When the pressure is applied to a plurality of overlapping layers, an equal pressure is applied to all layers. That is, the contact pressure U is applied to each of the overlapping portion of the surface layer binder resin 423*a* and the overlapping portion of the coarse particle 423*b*. Therefore, from the definition of the elastic modulus, when the compression ratios of the surface layer binder resin 423*a* and the coarse particle 423*b* are Ag and Ah, the compression ratios are represented by Equations 5 and 6 below, respectively.

$$\Delta g=U/A \quad \text{(Equation 5)}$$

$$\Delta h=UB \quad \text{(Equation 6)}$$

Using the compression ratios Δh and Δg, the compression height of the surface layer binder resin 423*a* is g×Δg, and the compression height of the coarse particle 423*b* is h×Δh. When the compression ratio of the surface layer 423 is Δk, the compression ratio Δk is represented by Equation 7 below by regarding that the surface layer 423 is a layer structure of the surface layer binder resin 423*a* and the coarse particle 423*b*.

$$\Delta k=(g\times\Delta g+h\times\Delta h)/(g+h) \quad \text{(Equation 7)}$$

Moreover, the elastic modulus R of the surface layer 423 is represented by Equation 8 below from the definition of the elastic modulus.

$$R=U/\Delta k \quad \text{(Equation 8)}$$

When Equations 4 to 7 are applied to Equation 8, the elastic modulus R of the surface layer 423 is represented by Equation 9 below using the elastic modulus A of the surface layer binder resin 423*a*, the elastic modulus B of the coarse particle 423*b*, and the thickness ratio e.

$$R=(1+e)/(1/A+e/B) \quad \text{(Equation 9)}$$

The elastic modulus R of the surface layer 423 can be calculated by substituting the measurement values of the elastic modulus A of the surface layer binder resin 423*a*, the elastic modulus B of the coarse particle 423*b*, and the thickness ratio e, obtained by the above-described measurement method, into Equation 9.

From Equation 9, a direction in which the elastic modulus A of the surface layer binder resin 423*a* and the elastic modulus B of the coarse particle 423*b* increase is a direction in which the elastic modulus R of the surface layer 423 increases. Moreover, the elastic modulus R of the surface layer 423 is larger than the smaller one of the elastic modulus A of the surface layer binder resin 423*a* and the elastic modulus B of the coarse particle 423*b*. Moreover, the elastic modulus R of the surface layer 423 is smaller than the larger one of the elastic modulus A of the surface layer binder resin 423*a* and the elastic modulus B of the coarse particle 423*b*.

Here, a large elastic modulus R of the surface layer 423 indicates that it is not easily crushed when a prescribed pressure is applied to the surface layer 423. When the elastic modulus R of the surface layer 423 is large, since a particle portion 423*e* which is a protrusion due to the coarse particle 423*b* is not easily depressed or deformed in a flat shape, the contact area S is likely to decrease. Due to this, when the elastic modulus R of the surface layer 423 is large, the contact pressure U is likely to increase from the relationship of Equation 3.

In the present example, in order to suppress occurrence of image smearing, the elastic modulus R of the surface layer 423 is set to 50 MPa or more so that the contact pressure U is 5.8 N/mm$^2$ or more. Moreover, if the elastic modulus R of the surface layer 423 is large and the contact pressure U is too large, since the surface of the photosensitive drum 1 is locally scraped deeply to form vertical streaks and the photosensitive drum 1 is likely to be scraped, the thickness cannot be maintained appropriately, and it is difficult to extend the life of the photosensitive drum. Therefore, it is preferable to set the contact pressure U to 873 N/mm$^2$ or smaller. Moreover, the elastic modulus R of the surface layer 423 is preferably 6000 MPa or smaller.

Details of Example 1 and Comparative Example 1

Values of the drum contact pressure P, the contact area S, the contact portion pressure U, the elastic modulus A of the surface layer binder resin 423*a*, the elastic modulus B of the coarse particle 423*b*, and the elastic modulus R of the surface layer 423 in Example 1 (Examples 1-1 to 1-5), which is the present example, and Comparative Example 1 (Comparative Examples 1-1 to 1-4) are shown in Table 1. Table 1 also shows the evaluation results obtained in actual image formation using the process cartridges 8 of Examples 1 and Comparative Examples 1.

TABLE 1

| Configuration | Embodiment 1-1 | Embodiment 1-2 | Embodiment 1-3 | Embodiment 1-4 | Embodiment 1-5 | Comparative Example 1-1 | Comparative Example 1-2 | Comparative Example 1-3 | Comparative Example 1-4 |
|---|---|---|---|---|---|---|---|---|---|
| Drum contact pressure P (N/m) | 7.7 | 7.7 | 7.7 | 7.7 | 7.7 | 7.7 | 7.7 | 7.7 | 7.7 |
| Contact area S ($10^{-3}$ mm$^2$) | 1.0 | 1.2 | 1.7 | 2.5 | 2.6 | 2.9 | 4.9 | 4.9 | 5.0 |
| Contact portion pressure U (N/mm$^2$) | 14.8 | 12.5 | 8.9 | 6.0 | 5.8 | 5.2 | 3.1 | 3.1 | 3.0 |
| Modulus of elasticity A of surface layer binder resin (Mpa) | 100 | 50 | 20 | 100 | 50 | 20 | 100 | 50 | 20 |
| Modulus of elasticity B of coarse particle (Mpa) | 200 | 200 | 200 | 50 | 50 | 50 | 10 | 10 | 10 |
| Modulus of elasticity R of surface layer (Mpa) | 178 | 145 | 94 | 53 | 50 | 42 | 11 | 11 | 11 |
| Image smearing evaluation result | ○ | ○ | ○ | Δ | Δ | x | x | x | x |
| Image density evaluation result | ○ | ○ | ○ | ○ | ○ | ○ | ○ | ○ | ○ |

Examples 1-1, 1-2, 1-3, 1-4, and 1-5

In all of Examples 1-1 to 1-5, the ten-point average roughness Rzjis of the surface of the developing roller 42 is made greater than the volume average particle diameter of the toner 90. This makes it easier for the protrusions on the surface of the developing roller 42 to scrape off the discharge products on the photosensitive drum 1 without passing through the toner layer. Further, in each of Examples 1-1 to 1-5, the predetermined penetration level d is adjusted in accordance with the developing roller 42 of each example so that the drum contact pressure P becomes 7.7 N/m. More specifically, the drum contact pressure P for each penetration level d is measured by using a plurality of inter-shaft regulating members 45 ensuring a plurality of different penetration levels d by the above-described method for measuring the drum contact pressure P. The penetration level d when the drum contact pressure P reaches a target value is thus obtained from the correlation between the drum contact pressure P and the penetration level d. For example, in Example 1-3, the predetermined penetration level d was set to 0.03 mm as the penetration level d at which the drum contact pressure P was 7.7 N/m. In Example 1-5, the value of the nip width n was 0.51 mm.

Furthermore, as shown in Table 1, in the configuration of the present embodiment, the contact area S is reduced and the contact portion pressure U is increased by increasing the elastic modulus R of the surface layer 423. In Embodiments 1-1 to 1-5, the elastic modulus R of the surface layer 423 was set to be larger than 50 MPa. Furthermore, in Embodiments 1-1 to 1-3, the elastic modulus R of the surface layer 423 was set to be larger than 94 MPa. In order to obtain such an elastic modulus R of the surface layer 423, as shown in Table 1, the materials, etc., of the surface layer binder resin 423*a* and the coarse particle 423*b* are adjusted so as to increase the elastic modulus A of the former or to increase the elastic modulus B of the latter.

Comparative Examples 1-1, 1-2, 1-3, and 1-4

The surface layer 423 of the developing roller 42 of Comparative Examples 1-1 to 1-4 will be described hereinbelow. Since the configuration other than the surface layer 423 of the developing roller 42 is substantially the same as that of Embodiment 1, the description thereof is herein omitted.

As shown in Table 1, in Comparative Examples 1-1 to 1-4, the surface layer binder resin 423*a* having a lower elastic modulus or the coarse particle 423*b* having a lower elastic modulus than in Embodiments 1-1 to 1-5 was used. Therefore, the elastic modulus R of the surface layer 423 is smaller than 50 MPa. As a result, the contact portion pressure U is smaller than 5.8 N/mm$^2$.

Evaluation Method

Described herein is an image smearing evaluation method performed to confirm the effects of the present embodiment. Regarding the image smearing, character blurring in the output image at the time of printing a character image was visually determined and evaluated based on the following criteria. Thus, symbol x corresponds to the case where the character blur was remarkable and there was a problem in actual use, symbol Δ corresponds to the case where slight character blurring has occurred, but there was no problem in actual use, and symbol o corresponds to the case where no character blurring has occurred.

In the evaluation of the image smearing, a paper-passing test of 4000 prints was performed in an environment of a temperature of 30° C. and a relative humidity of 80% in each of the embodiments and comparative examples, followed by verification after allowing the apparatus to stand without paper-passing for 12 h or more.

Comparison of Example 1 and Comparative Examples 1

In Table 1, comparing the evaluation results of Embodiments 1-1 to 1-5 and Comparative Examples 1-1 to 1-4, in which the drum contact pressure P is set to substantially the same value, the image smearing is less likely to occur as the contact portion pressure U increases. This is because the surface layer 423 of the developing roller 42 partially comes into contact with the photosensitive drum 1 under a stronger pressure, and the discharge products adhered to the photosensitive drum 1 are easily scraped off.

Therefore, as shown in Table 1, in order to enhance the effect of suppressing image smearing, the contact portion pressure U is preferably 5.8 N/mm$^2$ or more as in Embodiments 1-1 to 1-5.

Further, the elastic modulus R of the surface layer 423 of the developing roller 42 is preferably set to 50 MPa or more as in Embodiments 1-1 to 1-5 so as to obtain such a contact portion pressure U. The reason therefor can be considered as follows. Where the elastic modulus R of the surface layer 423 of the developing roller 42 is large, the particle portion 423*e* protruding due to the inclusion of the coarse particle 423*b* of the developing roller 42, such as shown in FIG. 4B, is less likely to be crushed. Therefore, each contact portion Q is decreased in size and the number thereof is also reduced, so that the contact area S is likely to decrease. It is considered that this makes it possible to increase the contact portion pressure U.

In Embodiment 1 (Embodiments 1-1 to 1-5), the occurrence of image smearing is suppressed since the discharge products are scraped off by the developing roller 42. Therefore, it is possible to prevent the apparatus size and cost from being increased as a result of providing a means, other than the developing roller 42, for removing the discharge product. Also, it is possible to prevent the decrease in convenience for the user that is caused by frequent performance of discharge product removal operation during a non-image formation period.

In particular, in the conventional image forming apparatus of the image bearing member cleaner-less type, in which no cleaning unit is provided on the photosensitive drum 1, image smearing easily occurs since the surface of the photosensitive drum 1 is not scraped by the cleaning unit. However, according to the configuration of the present embodiment, it is possible to suppress the occurrence of image smearing with a simple configuration without lowering the convenience for the user.

Embodiment 2

Hereinafter, Embodiment 2 will be described. The basic configuration and operation of the image forming apparatus 100 are the same as those of Embodiment 1. Accordingly, elements having the same or corresponding functions or configurations as those of the image forming apparatus 100 of Embodiment 1 are denoted by the same reference numerals as those in Embodiment 1, and detailed description thereof is omitted.

In the above-described Embodiment 1, the inter-shaft regulating member 45 is provided between the developing roller 42 and the photosensitive drum 1, and the penetration level d of the developing roller 42 into the photosensitive drum 1 is regulated. This configuration ensures that the pressure P does not increase more than necessary.

However, when the penetration level d is increased due to the configuration in which the inter-shaft regulating member 45 is not provided, the repulsion force increases as the penetration level d increases, and the drum contact pressure P increases. It was found that in such a configuration in which the drum contact pressure P is large, image defects caused by deterioration of the developing apparatus 4 are likely to occur due to long-term use or the like, and it may be difficult to extend the life of the developing apparatus 4. The reason therefore will be described below. That is, when the drum contact pressure P is large, the pressure and the frictional force acting on the toner 90 increase. As a result, cracking of the toner 90, reduction of the effect of the external additive externally added to the toner 90, and contamination of the developing roller 42, the regulating blade 44, and the like by the external additive are likely to occur. Where such a deterioration of the developing apparatus 4 occurs, a layer of the toner 90 having a stable layer thickness cannot be formed on the developing roller 42, or the charging of the toner 90 becomes inadequate. Further, the attachment force of the toner 90 to the photosensitive drum 1 may be increased, and the toner 90 may adhere to the non-printing portion. For this reason, image defects such as a decrease in image density in a printing portion and fogging in a non-printing portion occur.

Accordingly, in the present embodiment, similarly to Embodiment 1, the inter-shaft regulating member 45 is provided, and the developing roller 42 abuts on the photosensitive drum 1 so as to have a predetermined penetration level d. The drum contact pressure P at that time is set to be 20 N/m or less. Thus, since the drum contact pressure P is reduced, rather than excessively increased, the deterioration of the developing apparatus 4 can be suppressed. As a result, the occurrence of image defects such as a decrease in image density is suppressed, and the life of the developing apparatus 4 can be extended.

Details of Embodiment 2 and Comparative Example 2

Values of the drum contact pressure P, the contact area S, the contact portion pressure U, the elastic modulus A of the surface layer binder resin 423*a*, the elastic modulus B of the coarse particle 423*b*, and the elastic modulus R of the surface layer 423 in Embodiment 2 (Embodiments 2-1 and 2-2), which is the present embodiment, and Comparative Example 2 (Comparative Examples 2-1 and 2-2) are shown in Table 2. Table 2 also shows the evaluation results obtained in actual image formation using the process cartridges 8 of Embodiments 2 and Comparative Examples 2.

TABLE 2

| Configuration | Embodiment 2-1 | Embodiment 2-2 | Comparative Example 2-1 | Comparative Example 2-2 |
|---|---|---|---|---|
| Drum contact pressure P (N/m) | 20.0 | 20.0 | 42.6 | 42.6 |
| Contact area S ($10^{-3}$ mm$^2$) | 2.2 | 4.0 | 3.0 | 5.0 |
| Contact portion pressure U (N/mm$^2$) | 12.6 | 7.1 | 16.3 | 9.9 |
| Modulus of elasticity A of surface layer binder resin (MPa) | 20 | 50 | 20 | 50 |
| Modulus of elasticity B of coarse particle (MPa) | 200 | 50 | 200 | 50 |
| Modulus of elasticity R of surface layer (MPa) | 94 | 50 | 94 | 50 |
| Image smearing evaluation result | ○ | Δ | ○ | ○ |
| Image density evaluation result | ○ | ○ | x | x |

Embodiments 2-1 and 2-2

The surface layer 423 of the developing roller 42 in Embodiments 2-1 and 2-2 is the same as that in Embodiment 1-3 and Embodiment 1-5, respectively, which are described hereinabove. However, in Embodiments 2-1 and 2-2, the thickness of the inter-shaft regulating member 45 from the shaft core 421 side to the photosensitive drum 1 side was reduced, and the penetration level d was increased. Therefore, as shown in Table 2, in this configuration the drum contact pressure P is higher than those of Embodiments 1-3 and 1-5. Since the configuration other than the inter-shaft regulating member 45 is substantially the same as that of Embodiment 1, the description thereof is herein omitted. In Embodiment 2-1, the predetermined penetration level d was set to 0.06 mm in order to set the drum contact pressure P to 20.0 N/m. Further, in Comparative Example 2-1, the predetermined penetration level d was set to 0.10 mm in order to set the drum contact pressure P to 42.6 N/m. In Embodiment 2-1 and Comparative Example 2-1, the nip width n was 0.71 mm and 0.86 mm, respectively.

As shown in Table 2, in Embodiments 2-1 and 2-2, the drum contact pressure P when measuring the contact area S with the glass plate I is larger as compared with Embodiments 1-3 and 1-5, respectively, and therefore, the contact area S is slightly increased because the surface layer 423 is further collapsed. However, since the drum contact pressure P is large, the contact portion pressure U has increased.

Comparative Examples 2-1 and 2-2

The surface layer 423 of the developing roller 42 of Comparative Examples 2-1 and 2-2 is the same as that of Embodiments 1-3 and 1-5, respectively. However, in the configuration of Comparative Examples 2-1 and 2-2, the inter-shaft regulating member 45 is omitted. Therefore, as shown in Table 2, the drum contact pressure P is higher than in Embodiments 1-3 and 1-5. Further, the configuration is such that the drum contact pressure P is higher than in Embodiments 2-1 and 2-2 in which the drum contact pressure P is higher than in Embodiments 1-3 and 1-5. Accordingly, the penetration level d into the photosensitive drum 1 may not be regulated by the inter-shaft regulating member 45, and the penetration level d also increases. Since the features other than the presence or absence of the inter-shaft regulating member 45 are substantially the same as in Embodiment 1, the description thereof is herein omitted.

As shown in Table 2, in Comparative Examples 2-1 and 2-2, the drum contact pressure P when measuring the contact area S with the glass flat plate I is larger than in Embodiments 2-1 and 2-2, respectively, and therefore, the contact area S is slightly increased because the surface layer 423 is further collapsed. However, since the drum contact pressure P is large, the contact portion pressure U has increased.

Evaluation Method

Described herein is an image density evaluation method performed to confirm the effects of the present embodiment. Regarding the image density, an image including a plurality of patches for printing solid black 10-mm squares was printed on a white recording paper, and the density of the solid black printing portion was measured in five points in one piece of paper by using a color reflection densitometer X-Rite 504 (manufactured by X-Rite), and the average value thereof was defined as the image density. Symbol x corresponds to the case where the image density reduced to less than 1.2, and symbol o corresponds to the case where the image density was 1.2 or more.

In the evaluation of image density, in the same manner as in Embodiment 1, a paper-passing test of 4000 prints was performed in an environment of a temperature of 30° C. and a relative humidity of 80% in each of the Embodiments and Comparative Examples, followed by verification after allowing the apparatus to stand without paper-passing for 12 h or more.

Further, in the present embodiment, the surface layer 423 of the developing roller 42 has the same configuration as that of Embodiments 1-3 and 1-5, and the evaluation of the image smearing was also performed. The image smearing evaluation results are shown in Table 2 together with the image density evaluation results.

Comparison of Embodiment 2 and Comparative Examples 2

Here, comparison of the results of Embodiment 2 and Comparative Examples 2 will be described. Since the surface layer 423 of the developing roller 42 has the same configuration as that of Embodiments 1-3 and 1-5, a comparison with Embodiment 1 will also be described.

In Comparative Examples 2-1 and 2-2, since the contact portion pressure U is 5.8 N/mm$^2$ or more, good results are obtained in terms of image smearing. However, compared to Embodiments 1-3 and 1-5 in which the elastic modulus R of the surface layer 423 is the same, a decrease in image density is observed. This is because the deterioration of the developing apparatus 4 was promoted by the drum contact pressure P being larger than 20 N/m. As described above, when the deterioration of the developing apparatus 4 occurs, it becomes impossible to form a layer of the toner 90 having a stable layer thickness on the developing roller 42, or the charging of the toner 90 becomes inadequate. As a result, image defects such as a decrease in density in the printing portion occur.

In Embodiments 2-1 and 2-2, since the drum contact pressure P is set to 20 N/m or less, the deterioration of the developing apparatus 4 is suppressed, and the image density does not decrease. As shown in Table 2, in Embodiment 2-1 in which the elastic modulus R of the surface layer 423 is the same as in Comparative Example 2-1, the drum contact pressure P is 20 N/m or less, so that the decrease in image density does not occur. Further, in Embodiment 2-2 in which the elastic modulus R of the surface layer 423 is the same as in Comparative Example 2-2, the decrease in image density also does not occur because the drum contact pressure P is 20 N/m or less. As a result, the life of the developing apparatus 4 can be extended. In addition, even if the drum contact pressure P is low, the condition that the contact portion pressure U in Embodiment 1 is 5.8 N/mm$^2$ or more is satisfied, the surface of the developing roller 42 is partially in strong contact with the photosensitive drum 1, discharge products are easily removed, so that image smearing can be suppressed.

Therefore, in the configuration of Comparative Examples 2 (Comparative Examples 2-1 and 2-2), it is impossible to achieve both a longer life of the developing apparatus 4 and suppression of the occurrence of image smearing, whereas in the configuration of Embodiment 2 (Embodiments 2-1 and 2-2), it is possible to achieve both a longer life of the developing apparatus 4 and suppression of the occurrence of image smearing. In Embodiments 1-1 to 1-5 in Embodiment 1, since the contact portion pressure U is 5.8 N/mm$^2$ or more and the drum contact pressure P is 20 N/m or less, a configuration is realized such that it is possible to achieve both a longer life of the developing apparatus 4 and suppression of the occurrence of image smearing.

As described above, according to the configuration of the present embodiment, it is possible to suppress the occurrence of image smearing while increasing the life of the developing apparatus 4 with a simple configuration without lowering convenience for the user.

Embodiment 3

The configurations of the present Embodiment 3 and Comparative Example 3 (Comparative Examples 3-1 and 3-2) are shown below. The basic configuration and operation of the image forming apparatus 100 are the same as those of Embodiment 1. Therefore, in the image forming apparatuses 100 of the present Embodiment 3 and Comparative Example 3, elements having the same or corresponding functions or configurations as those of the image forming apparatus 100 of Embodiment 1 are denoted by the same reference numerals, and the detailed description thereof is herein omitted.

In the case of an image forming apparatus employing a contact developing method as in the present embodiment and using the developing roller 42 having minute unevenness formed on the surface, where images are formed over a long period of time, the toner 90 may be caught between the protrusions on the surface of the developing roller 42 and the surface of the photosensitive drum 1. At this time, where the toner 90 caught between the protrusion on the surface of the developing roller 42 and the surface of the photosensitive drum 1 is crushed, dot-like toner melt adhesion to the photosensitive drum 1 occurs. It was found that in such a case, at the portion where the toner 90 is fused, the latent image formation by the exposing unit 3 becomes insufficient, the toner 90 is not developed, and the output image has a white spot which is an image defect.

The present embodiment is aimed at suppressing such toner melt adhesion. This embodiment is characterized in that a conductive material is used for the regulating blade 44 as a developer regulating member for regulating the toner 90 on the developing roller 42 to a desired amount, and the conductive material is configured to enable voltage application. Another feature is that a bias is applied to the regulating blade 44 from the voltage applying means 110 of the image forming apparatus 100. Yet another feature is that an insulator is used for the coarse particles 423*b* contained in the surface layer 423 of the developing roller 42, and the bias applied to the regulating blade 44 has the same polarity as the charging polarity of the toner 90.

Configuration of Developing Apparatus

The developing roller 42, the regulating blade 44, the applied bias, and the toner 90 of the present embodiment are set as described below.

Embodiment 3

Coarse particles 423*b*: insulator (urethane particles, average particle size 50 μm)

Regulating blade 44: SUS

Drum contact pressure P (N/m): 20.0

Contact portion pressure U (N/mm$^2$): 37.7

Voltage applied to the regulating blade 44: DC −500V

Voltage applied to the developing roller 42: DC −300V

Potential difference between the voltage applied to the developing roller 42 and the voltage applied to the regulating blade 44 (potential difference obtained by subtracting the potential of the developing roller from the potential of the regulating blade): −200 V Charging Polarity of the Toner 90: Negative In the present embodiment, the drum contact pressure P was set to 20 N/m or less in order to satisfy the image density even in a long-term durability test, the contact portion pressure U was sufficiently increased to suppress image smearing, and the discharge products were scraped off satisfactorily even in the long-term durability test.

Further, a voltage of DC −300 V is applied to the developing roller 42 from a voltage applying means (not shown) and a voltage of DC −500 V is applied to the regulating blade 44 from the voltage applying means 110 as a developing bias acting on the development of the toner 90. The potential difference between the voltage applied to the developing roller 42 and the voltage applied to the regulating blade 44 is set to the negative polarity side (−200 V in the present embodiment) which is the same polarity as the charging polarity of the toner 90. By doing so, the charge-providing performance to the toner 90 having negative charging performance is improved, and the amount of the toner 90 having a low charge quantity is reduced.

In the Comparative Example, the developing roller 42, the regulating blade 44, the applied bias and the toner 90 are set as follows.

Comparative Example 3-1

Coarse particles 423*b*: conductor (spherical carbon particles, average particle diameter 50 μm)

Regulating blade 44: SUS

Drum contact pressure P (N/m): 20.0

Contact portion pressure U (N/mm$^2$): 37.7

Voltage applied to the regulating blade 44: DC −500V

Voltage applied to the developing roller 42: DC −300V

Potential difference between the voltage applied to the developing roller 42 and the voltage applied to the regulating blade 44: −200 V Charging polarity of the toner 90: negative A difference from the present Embodiment 3 is that a conductor is used for the coarse particles 423*b*. That is, the below-described exposed portion 423*c* of the coarse particle 423*b* is not charged.

Comparative Example 3-2

Coarse particles 423*b*: insulator (urethane particles, average particle diameter 50 μm)

Regulating blade 44: SUS

Drum contact pressure P (N/m): 20.0

Contact portion pressure U (N/mm$^2$): 37.7

Voltage applied to the regulating blade 44: DC −300V

Voltage applied to the developing roller 42: DC −300V

Potential difference between the voltage applied to the developing roller 42 and the voltage applied to the regulating blade 44: 0 V Charging polarity of the toner 90: negative A difference from the present Embodiment 3 is that the voltage applied to the regulating blade 44 is DC −300 V, and the potential difference between the voltage applied to the developing roller 42 and the voltage applied to the regulating blade 44 is 0 V. That is, the below-described exposed portion 423*c* of the coarse particle 423*b* is charged to a negative polarity which is the same polarity as that of the toner 90, but the charge quantity of the toner 90 is not stable.

Durability Test

A print durability test of 8000 prints was performed in a high-temperature and high-humidity environment. In order to verify the advantageous effects of the present embodiment, the configurations of Embodiment 3, Comparative Example 3-1 and Comparative Example 3-2 were evaluated. Specific conditions and image evaluation criteria are shown below.

Print Durability Test Conditions

Environment: temperature 30° C., humidity 80%

Printing mode: one print intermittent

Evaluation image output interval: every 1000 prints

Evaluation Criteria for Image Smearing

The image smearing was visually determined based on the following criteria by outputting a character image.

o: no character blurring

Δ: character blurring, but no problem in actual use x: character blurring and there is a problem in actual use Evaluation Criteria for Image Density Regarding the image density, an image including a plurality of patches for printing solid black 10-mm squares was printed on a white recording paper, and the density of the solid black printing portion was measured in five points on one piece of paper by using a color reflection densitometer X-Rite 504 (manufactured by X-Rite), and the average value thereof was defined as the image density.

o: 1.2 or more x: less than 1.2

Evaluation Criteria for White Spots

White spots (drum fusion) were visually determined based on the following criteria by outputting a solid black image.

o: no fine white spots in the output image

Δ: there are fine white spots in the output image, but no problem in actual use x: there are many large white spots in the output image Results Table 3 shows the evaluation results of the present Embodiment 3 and Comparative Examples 3-1 and 3-2.

TABLE 3

| Configuration | Embodiment 3 | Comparative Example 3-1 | Comparative Example 3-2 |
|---|---|---|---|
| Image smearing evaluation result | o | o | o |
| Image density evaluation result | o | o | o |
| White spot evaluation result | o | x | x |

Suppression of White Spots

In Comparative Examples 3-1 and 3-2, white spots were generated.

Here, the generation of white spots will be described. In Comparative Example 3, in which white spots are generated in the durability test, fusion of the toner 90 to the photosensitive drum 1 was observed.

Figure 5A:
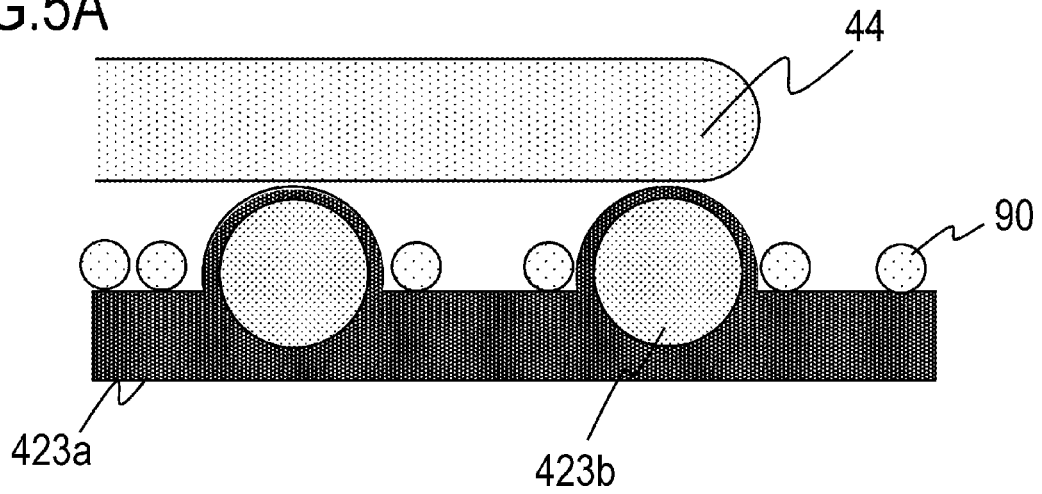
FIGS. 5A and 5B are diagrams for describing wear of a developing roller.
Figure 5B:
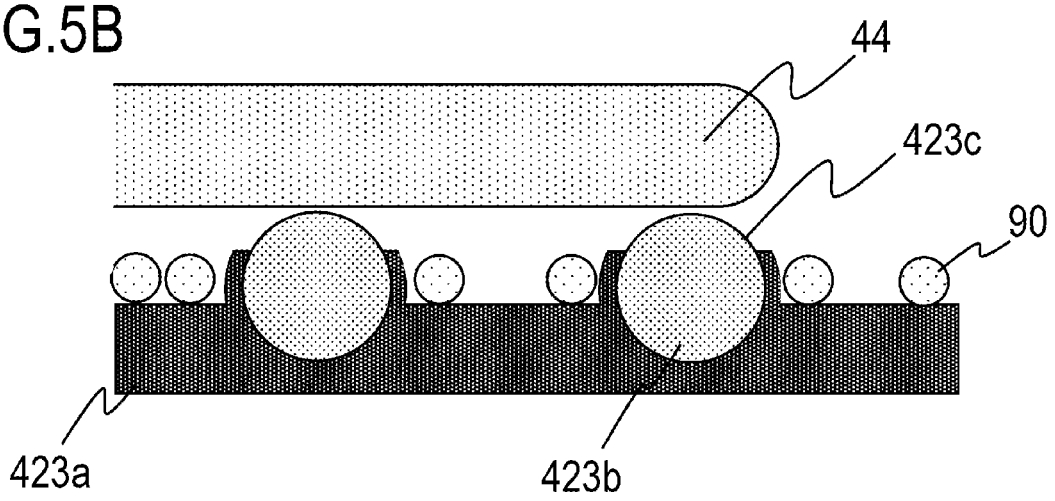
Figure 6:
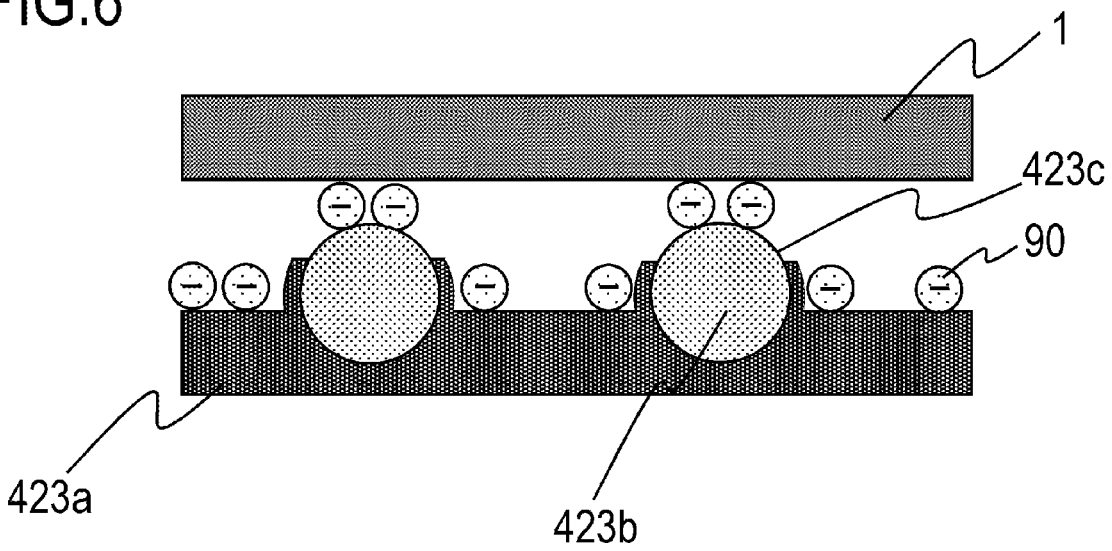
FIG. 6 is a diagram for describing the process of occurrence of white points.

This is described hereinbelow in detail. When image formation is repeatedly performed over a long period of time by the image forming apparatus 100, the surface layer binder resin 423*a* covering the coarse particles 423*b* of the surface layer 423 of the developing roller 42 as shown in FIG. 5A wears due to rubbing of the developing roller 42 and the regulating blade 44. Thus, as shown in FIG. 5B, the coarse particles 423*b* are exposed. Where the coarse particles 423*b* are exposed, the toner 90 may be caught between the exposed portion 423*c* of the coarse particles 423*b* and the surface of the photosensitive drum 1, as shown in FIG. 6. It is conceivable that at this time, the toner 90 is crushed at the contact portion between the coarse particles 423*b* of the developing roller 42 and the photosensitive drum 1, so that a point-like fusion to the photosensitive drum 1 occurs.

In the portion where the toner 90 is fused on the photosensitive drum 1, the latent image formation by the exposing unit 3 becomes insufficient, and the toner 90 is not developed in the fused portion, so that a white point is formed on the output image. In particular, it is considered that when the contact pressure U between the coarse particles 423*b* and the photosensitive drum 1 is high, the toner 90 is likely to be crushed, and the fusion occurs as shown in Table 3.

In Comparative Example 3-1, since the coarse particle 423*b* is a conductor, the exposed portion 423*c* of the coarse particle 423*b* is not charged by the voltage applied to the regulating blade 44. Therefore, the below-described repulsion force H does not act between the exposed portion 423*c* of the coarse particles 423*b* and the toner 90. In Comparative Example 3-2, the exposed portion 423*c* of the coarse particles 423*b* is charged to the same polarity as the toner 90, but the charge quantity of the toner 90 is not stable. Therefore, the below-described repulsion force H does not sufficiently act between the exposed portion 423*c* of the coarse particle 423*b* and the toner 90 having a low charge quantity.

As a result, in Comparative Examples 3-1 and 3-2, the toner 90 adhered to the exposed portion 423*c* of the coarse particle 423*b*, and the toner 90 was crushed between the exposed portion 423*c* and the photosensitive drum 1, thereby causing fusion which resulted in the output image having white spots.

Meanwhile, in the configuration of the present Embodiment 3, a satisfactory output image having no problems in terms of image density, occurrence of image smearing, and occurrence of white spots in the durability test was obtained.

In the present embodiment, when the image forming apparatus 100 is used for a long period of time, the adhesion of the toner 90 to the portion of the surface layer 423 of the developing roller 42 where the coarse particles 423*b* are exposed is suppressed. Accordingly, the toner 90 is not caught between the coarse particles 423*b* and the photosensitive drum 1, and fusion of the toner 90 to the photosensitive drum 1 is prevented, thereby making it possible to suppress the generation of white spots on the output image.

Figure 7A:
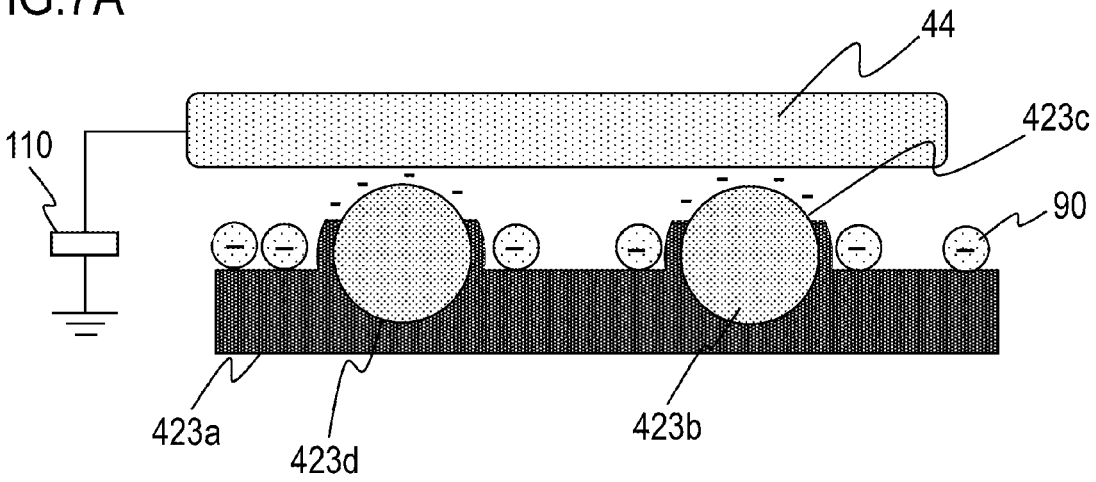
FIGS. 7A and 7B are diagrams illustrating how white points are suppressed in Embodiment 3.

This will be described in detail with reference to FIG. 7. In the present embodiment, the conductive regulating blade 44 and coarse particles 423*b* made of an insulator are provided, a voltage having the same polarity as the charging polarity of the toner 90 is applied from the developing roller 42 to the regulating blade 44 by the voltage applying means 110, and the exposed portions 423*c* of the coarse particles 423*b* are charged. More specifically, as shown in FIG. 7A, since the toner 90 has a negative charging polarity, a negative voltage is applied from the developing roller 42 to the regulating blade 44.

Figure 7B:
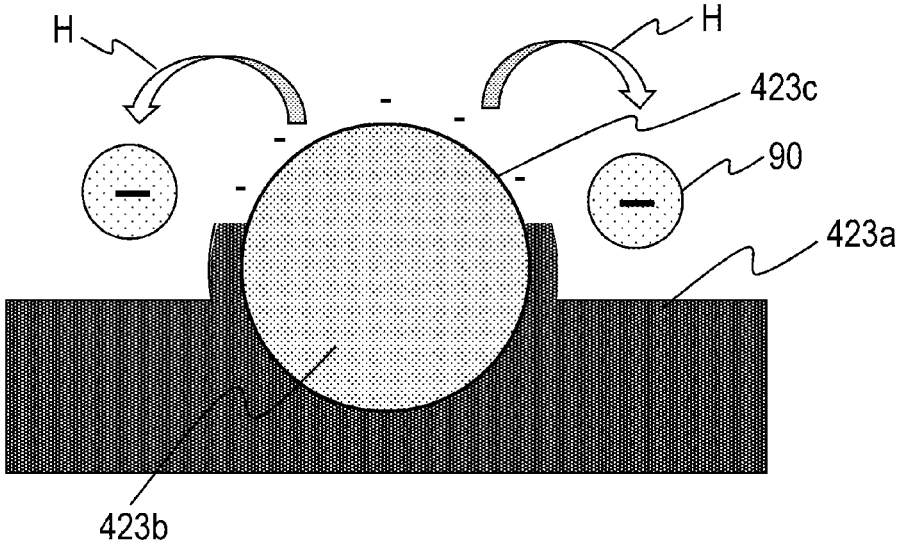

Thus, when the regulating blade 44 rubs against the surface of the developing roller 42 to regulate the layer thickness of the toner 90 on the developing roller 42, the surface of the exposed coarse particles 423*b* assumes a negative charging polarity which is the same polarity as the toner 90. At this time, as shown in FIG. 7B, the repulsion force H acts between the exposed portion 423*c* of the coarse particle 423*b* and the toner 90, and therefore, the toner 90 is less likely to adhere to the exposed portion 423*c* of the coarse particle 423*b*. Therefore, the toner 90 is less likely to be caught between the coarse particle 423*b* and the photosensitive drum 1, thereby making it possible to prevent the toner 90 from collapsing and fusing to the surface of the photosensitive drum 1.

The voltage which is to be applied to the regulating blade 44 will be described hereinbelow in more detail. In the present embodiment, a voltage of DC −300 V is applied to the developing roller 42 from a voltage applying means (not shown), and a voltage of DC −500 V is applied to the regulating blade 44 from the voltage applying means 110 as a developing bias acting on the development of the toner 90. The potential difference between the voltage applied to the developing roller 42 and the voltage applied to the regulating blade 44 is set to a negative polarity side (−200 V in this embodiment) which is the same polarity as the charging polarity of the toner 90. By doing so, the charge-providing performance to the toner 90 having negative charging performance is improved, and the amount of the toner 90 having a low charge quantity is reduced. This stabilizes the repulsion force H acting between the exposed portion 423*c* of the coarse particle 423*b* and the toner 90. As a result, the toner 90 was less likely to be caught between the coarse particle 423*b* and the surface of the photosensitive drum 1, and the toner 90 was prevented from being crushed and fused to the surface of the photosensitive drum 1. As a result, a satisfactory output image with no white spots was obtained.

As described above, an insulator is used for the coarse particles 423*b* contained in the surface layer 423 of the developing roller 42. The voltage applied to the conductive regulating blade 44 and the potential difference between the voltage applied to the developing roller 42 and the voltage applied to the regulating blade 44 are formed such that the polarity on the regulating blade 44 side becomes the same as the charging polarity of the toner 90. By doing so, the exposed portion 423*c* of the coarse particle 423*b* contained in the surface layer 423 of the developing roller 42 is charged to the same polarity as the charging polarity of the toner 90. As a result, a repulsion force H is generated between the toner 90 provided with an electric charge by the regulating blade 44 and the exposed portion 423*c* of the coarse particle 423*b* contained in the surface layer 423 of the developing roller 42, and the toner 90 is unlikely to adhere to the exposed portion 423*c* of the coarse particle 423*b*. Since the toner 90 is less likely to be caught between the coarse particle 423*b* and the surface of the photosensitive drum 1, the fusion of the toner 90 to the surface of the photosensitive drum 1 can be suppressed. As a result, a satisfactory output image free of image smearing and white spots can be obtained over a long period of time while satisfying the image density.

In the present embodiment, an embodiment is shown in which the surface layer 423 of the developing roller 42 is worn and the coarse particles 423*b* are exposed by repeated image formation in the image forming apparatus 100. However, even when the developing roller 42 having the coarse particles 423*b* having the exposed portions 423*c* is provided from the beginning, the same operational effect can be obtained, and a satisfactory output image can be obtained.

Embodiment 4

This embodiment, similarly to Embodiment 3, is aimed at suppressing the fusion of toner to the photosensitive drum 1.

The present embodiment is characterized in that when the coarse particles 423*b* contained in the surface layer 423 of the developing roller 42 are rubbed by the regulating blade 44, the rubbed portion of the coarse particle 423*b* charged by the rubbing has the same charging polarity as the toner 90. The difference from Embodiment 3 is that charging to the same polarity as the charging polarity of the toner 90 is performed not only when the surface of the coarse particle 423*b* is exposed, but also when the rubbing further advances and the coarse particle 423*b* is worn. The configurations of the present Embodiment 4 (Embodiments 4-1 and 4-2) and Comparative Example 4-1 are shown hereinbelow. The toner 90 and the regulating blade 44 are the same as those of Embodiment 3, and include the negatively-charged toner 90 and the SUS regulating blade 44. Further, the elastic layer 422 and the surface layer binder resin 423*a* of the developing roller 42 are the same as in Embodiment 3. In the present embodiment, the coarse particles 423*b* contained in the surface layer 423 were changed. Other than that, the drum contact pressure P=20.0 (N/m) and the contact portion pressure U=37.7 (N/mm$^2$) were the same as the conditions in Embodiment 3. As for the applied bias, the voltage applied to the regulating blade 44 was DC −300 V, and the voltage applied to the developing roller 42 was DC −300 V, as in Comparative Example 3-2. Therefore, the potential difference between the voltage applied to the developing roller 42 and the voltage applied to the regulating blade 44 is 0 V. However, this value is not limiting in terms of obtaining the effect of suppressing the fusion of the toner to the photosensitive drum 1 in the present embodiment.

Configuration of Developing Apparatus

Here, the coarse particles 423*b* used for the developing roller 42 of the present embodiment will be described below.

Embodiment 4-1

Coarse particles 423*b*: urethane particles, average particle diameter 50 μm.

Negatively chargeable spherical silica particles 423*d* were coated at 2.0% by weight on the coarse particles 423*b*. When the SUS of the regulating blade 44 provided in the present embodiment and the exposed coarse particles 423*b* rub against each other, the charging polarity of the surface of the coarse particles 423*b* becomes negative due to the action of the silica coated on the surface of the coarse particles 423*b*.

Embodiment 4-2

Coarse particles 423*b*: polystyrene particles, average particle diameter 50 μm. When the SUS of the regulating blade 44 provided in the present embodiment and polystyrene as the coarse particles 423*b* rub against each other, the polystyrene assumes a negative polarity due to the relationship of the charging sequence of the materials. Therefore, the coarse particles 423*b* are negatively charged not only when the surface of the coarse particles 423*b* is exposed, but also when the coarse particles 423*b* are worn.

As a comparative example, the following particles are used as the coarse particles 423*b* used for the developing roller 42.

Comparative Example 4-1

Coarse particles 423*b*: acrylic particles, average particle diameter 50 μm.

When the SUS of the regulating blade 44 provided in the present embodiment and the acryl of the coarse particles 423*b* rub against each other, the acryl assumes a polarity polarity due to the relationship of the charging sequence of the materials.

Durability Test

For verification, a print durability test of 8000 prints was performed in a high-temperature and high-humidity environment using the same conditions and evaluation criteria as in the evaluation in Embodiment 3, and image smearing, image density, and white points (drum fusion) were evaluated. For comparison, the same operations were performed in Comparative Example 4-1.

Results

Table 4 shows the evaluation results of Embodiments 4-1 and 4-2 and

Comparative Example 4-1

TABLE 4

| Configuration | Embodiment 4-1 | Embodiment 4-2 | Comparative Example 4-1 |
|---|---|---|---|
| Image smearing evaluation result | ○ | ○ | ○ |
| Image density evaluation result | ○ | ○ | ○ |
| White spot evaluation result | ○ | ○ | xx |

Operational Effects

When the developing roller 42 rotates during image formation and the toner 90 held on the developing roller 42 is regulated to a desired amount and charged by the regulating blade 44, the coarse particles 423*b* contained in the surface layer 423 of the developing roller 42 rub with the regulating blade 44. At this time, the toner 90 is charged to a negative polarity.

The acrylic particles of Comparative Example 4-1 are charged to a positive polarity by rubbing with the SUS of the regulating blade 44. For this reason, a force acted to attract the toner 90 to the exposed portion 423*c* of the coarse particle 423*b*, the toner 90 adhered to the exposed portion 423*c* of the coarse particle 423*b* from the middle stage to the latter half of the durability test, and noticeable fusion on the surface of the photosensitive drum 1 started to occur. As a result, output images having a clearly large white spot were obtained from the middle stage to the latter half of the durability test. Therefore, the white point evaluation result in Table 4 was indicated as xx.

Figure 8A:
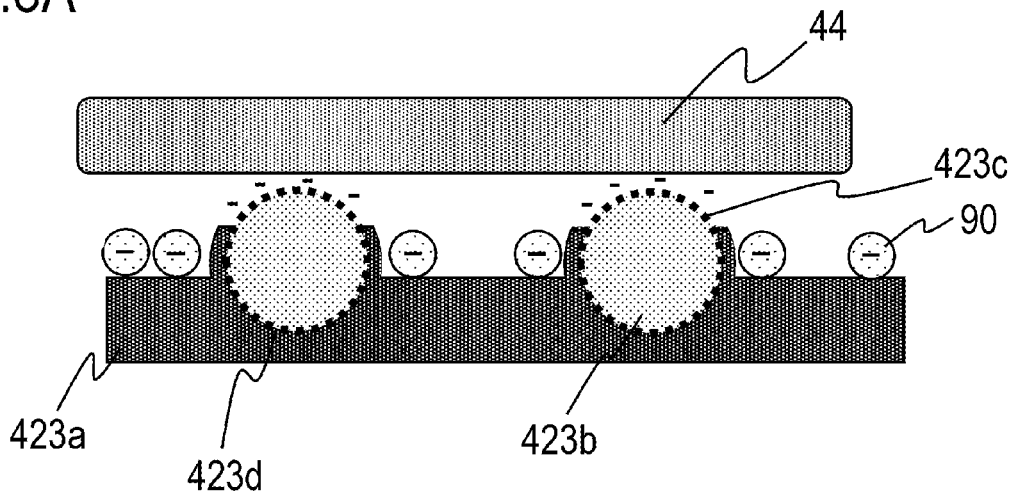
FIGS. 8A and 8B are diagrams for describing the effects of Embodiment 4.
Figure 8B:
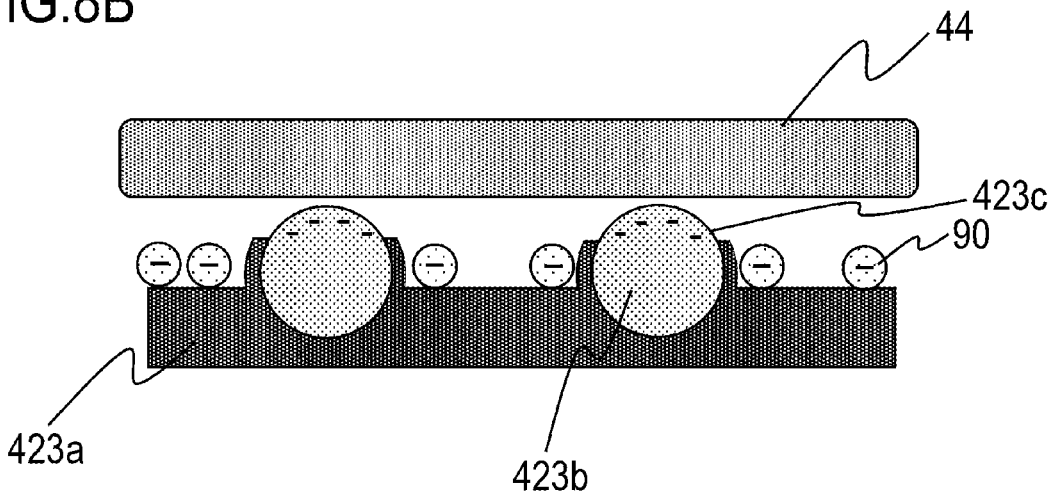

Meanwhile, in Embodiment 4-1 as shown in FIG. 8A, the silica 423*d* covering the coarse particles 423*b* of the surface layer 423 of the developing roller 42 is charged to a negative polarity due to the rubbing with the SUS of the regulating blade 44. Further, in Embodiment 4-2, as shown in FIG. 8B, polystyrene of the coarse particles 423*b* is charged to a negative polarity by rubbing of the coarse particles 423*b* of the surface layer 423 of the developing roller 42 with the SUS of the regulating blade 44.

Therefore, since the coarse particles 423*b* and the toner 90 were charged to the same polarity, the above-described repulsion force H acted and the adhesion of the toner 90 to the coarse particles 423*b* was suppressed. It is considered that as a result, similarly to Embodiment 3, the toner 90 is not caught between the photosensitive drum 1 and the coarse particles 423*b*, so that there is no fusion of the toner to the photosensitive drum 1 and a satisfactory output image without white spots was obtained.

As described above, the coarse particles 423*b* are used such that the charging polarity of the coarse particles 423*b* when the material of the coarse particles 423*b* contained in the surface layer 423 of the developing roller 42 and the material of the regulating blade 44 are charged by rubbing is the same as the polarity of the toner 90. By doing so, a repulsion force H is generated between the coarse particles 423*b* and the toner 90, and the toner 90 is unlikely to adhere to the coarse particles 423*b*. Since the toner 90 is less likely to be caught between the coarse particles 423*b* and the surface of the photosensitive drum 1, the fusion of the toner 90 to the surface of the photosensitive drum 1 can be suppressed as in Embodiment 3. As a result, a satisfactory output image free of image smearing and white spots can be obtained over a long period time while satisfying the image density.

Embodiment 5

The present embodiment will be described below. In a similar manner to Embodiments 3 and 4, the present embodiment concerns toner melt adhesion to the photosensitive drum 1. However, the present embodiment differs from Embodiments 3 and 4 which focus on how to suppress toner melt adhesion to the photosensitive drum 1 in that the present embodiment focuses on how to obtain a preferable image even when the toner 90 fuses to the photosensitive drum 1.

A configuration of the present embodiment will be described below. Similar to the conditions of Embodiments 3 and 4 described above, drum contact pressure P=20.0 (N/m) and contact portion pressure U=37.7 ($N/mm^2$) are adopted. A same configuration as Comparative Example 4-1 is used for comparison in which the modulus of elasticity R of the surface layer 423 is 296 MPa. The toner 90 and the regulating blade 44 are similar to those in Embodiments 3 and 4, with the toner 90 being a negative-charging toner and the regulating blade 44 being made of SUS. Regarding applied bias, in a similar manner to Comparative Example 4-1, applied voltage to the regulating blade 44 is set to DC-300 V and applied voltage to the developing roller 42 is set to DC-300 V. Therefore, a potential difference of the applied voltage to the regulating blade 44 relative to the applied voltage to the developing roller 42 is 0 V. However, this value is not restrictive for the purpose of obtaining an effect of suppressing a white point according to the present embodiment.

Embodiment 5-1

The present embodiment differs from Comparative Example 4-1 in a particle size of the coarse particles 423*b* which constitute the surface layer 423 of the developing roller 42. Specifically, acrylic particles (average particle diameter 30 μm) were used as the coarse particles 423*b*. The modulus of elasticity R of the surface layer 423 is 296 MPa.

Embodiment 5-2

The present embodiment differs from Comparative Example 4-1 in a particle size of the coarse particles 423*b* which constitute the surface layer 423 of the developing roller 42. Specifically, acrylic particles (average particle diameter 40 μm) were used as the coarse particles 423*b*. The modulus of elasticity R of the surface layer 423 is 296 MPa.

Durability Test

With respect to Embodiment 5-1, Embodiment 5-2, and Comparative Example 4-1, a print durability test of 8000 sheets was performed in a high temperature, high humidity environment using the same conditions and evaluation criteria as the evaluation according to Embodiment 3 described above to evaluate image smearing, image density, and white point (fusion of toner to drum).

Results

Evaluation results of Embodiment 5-1, Embodiment 5-2, and Comparative Example 4-1 are as shown in Table 5.

TABLE 5

| Configuration | Embodiment 5-1 | Embodiment 5-2 | Comparative example 4-1 |
|---|---|---|---|
| Image smearing evaluation result | ○ | ○ | ○ |
| Image density evaluation result | ○ | ○ | ○ |
| White point evaluation result | ○ | Δ | xx |

Operational Effect

First, a generation mechanism of a white point on a solid black image generated in Comparative Example 4-1 will be described from the perspective of fused matter size.

In Comparative Example 4-1 in which a large, visually confirmable white point had been generated in the durability test, a large fused matter of the toner 90 was observed on the photosensitive drum 1. In addition, in Embodiment 5-2 in which a fine white point which was difficult to visually confirm had been generated in the durability test in such a degree that the white point did not pose a problem in practical use, a fine fused matter of the toner 90 was observed on the photosensitive drum 1. Furthermore, in Embodiment 5-1 in which a white point was not generated on an output image in the durability test, fused matter of the toner 90 which was finer than that of Embodiment 5-2 was observed on the photosensitive drum 1.

A detailed description will now be given. In the developing roller 42 according to the present embodiment, due to the coarse particles 423*b* being included in the surface layer 423 as shown in FIG. 2B, a protruding particle portion 423*e* is formed on a surface. In a developing nip where the surface layer 423 of the developing roller 42 and the photosensitive drum 1 come into contact with each other, the particle portion 423*e* is crushed in accordance with moduli of elasticity of the surface layer binder resin 423*a* of the developing roller 42 and the coarse particles 423*b* and comes into contact with the developing nip. When image formation is performed over a long period of time in such a contact state, the toner 90 sandwiched between the particle portion 423*e* of the developing roller 42 and the photosensitive drum 1 is crushed at a contact portion and becomes fused onto the photosensitive drum 1. A size of the fused matter is, at a maximum, conceivably more or less the same size as a contact portion between the particle portion 423*e* of the developing roller 42 and the photosensitive drum 1. Therefore, when sizes of individual contact portions between the particle portion 423*e* and the toner increases, fused matter also increases.

Figure 9:
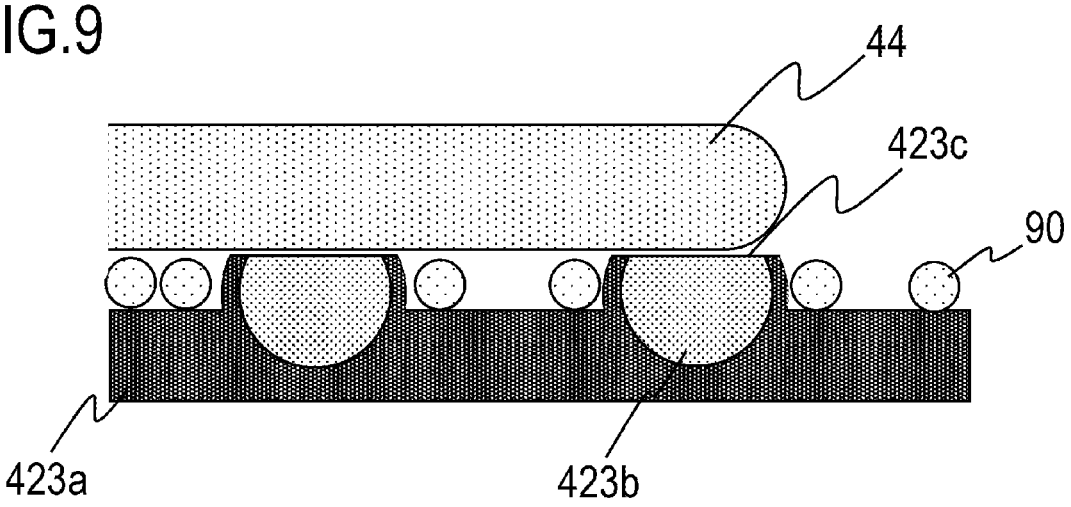
FIG. 9 is a diagram for describing wear of coarse particles of a developing roller.

Regarding the size of individual contact portions, in Embodiment 5-1, Embodiment 5-2, and Comparative Example 4-1, the size of a contact portion between the particle portion 423*e* of the developing roller 42 and the photosensitive drum 1 varies throughout a long-term durability test. Specifically, as described in Embodiment 3, in an early stage of the durability test, the surface layer binder resin 423*a* of the developing roller 42 covers the coarse particles 423*b* and is in contact in a state where the contact portion is small as shown in FIG. 5A. However, when image formation is performed through a durability test over a long period of time, the surface layer binder resin 423*a* wears away and the coarse particles 423*b* becomes exposed as shown in FIG. 5B. Furthermore, subsequently, an exposed portion 423*c* of the coarse particles 423*b* wears away due to rubbing against the regulating blade 44 as shown in FIG. 9 and the particle portion 423*e* acquires a flat surface. Therefore, the size of the contact portion increases as compared to before the abrasion of the particle portion 423*e* of the surface layer 423. Accordingly, throughout the durability test, the contact portion between the particle portion 423*e* of the developing roller 42 and the photosensitive drum 1 increases.

In a portion where the toner 90 is fused to the photosensitive drum 1, latent image formation by the exposing unit 3 is insufficient and, since the toner 90 is not developed in the fused portion, the fused portion ends up creating a white point on a solid black image. Since a size of a white point attributable to fused matter conceivably varies in accordance with a size of the fused matter, the size of the white point must be kept to or below a size that can be visually confirmed by the human eye on the output image. For example, when a maximum width of fused matter on the photosensitive drum 1 is larger than a width of a minimum pixel (1 dot) at the time of image formation, a white point can conceivably be visually confirmed on the output image. In the present embodiment, the 1 dot is formed using an image forming apparatus with a resolution of 600 dpi and corresponds to a diameter of approximately 42 μm.

With the configurations of Embodiments 5-1 and 5-2, preferable output images without problems in terms of generation of image smearing, a decline in image density, and generation of a white point were obtained in the durability test described above. This can be explained as follows. In both Embodiments 5-1 and 5-2, even when the particle portion 423*e* of the developing roller 42 is exposed and acquires a flat surface, a diameter of a surface of the exposed portion 423*c* which comes into contact with the photosensitive drum 1 is smaller than 30 μm and 40 μm which are respective average particle diameters of the coarse particles 423*b*. Therefore, since the particle portion 423*e* and the photosensitive drum 1 come into contact with each other by a surface of which a width is smaller than 1 dot, when the toner 90 is squashed between the particle portion 423*e* and the photosensitive drum 1, the toner 90 does not spread wider than a width of 1 dot.

As a result, even when the width of the contact portion between the particle portion 423*e* and the photosensitive drum 1 varies throughout a durability test, the width of the contact portion does not spread wider than the width of 1 dot. Therefore, even when the toner 90 is sandwiched between the particle portion 423*e* and the surface of the photosensitive drum 1 and the toner 90 is squashed and becomes fused to the surface of the photosensitive drum 1, a preferable output image without an image defect due to a white point is obtained.

Intensive studies carried out by the present inventors revealed that, by satisfying the conditions described below as in the present embodiment, a white point attributable to fused matter can be suppressed through a durability test.

White Point Suppressing Condition

Figure 10:
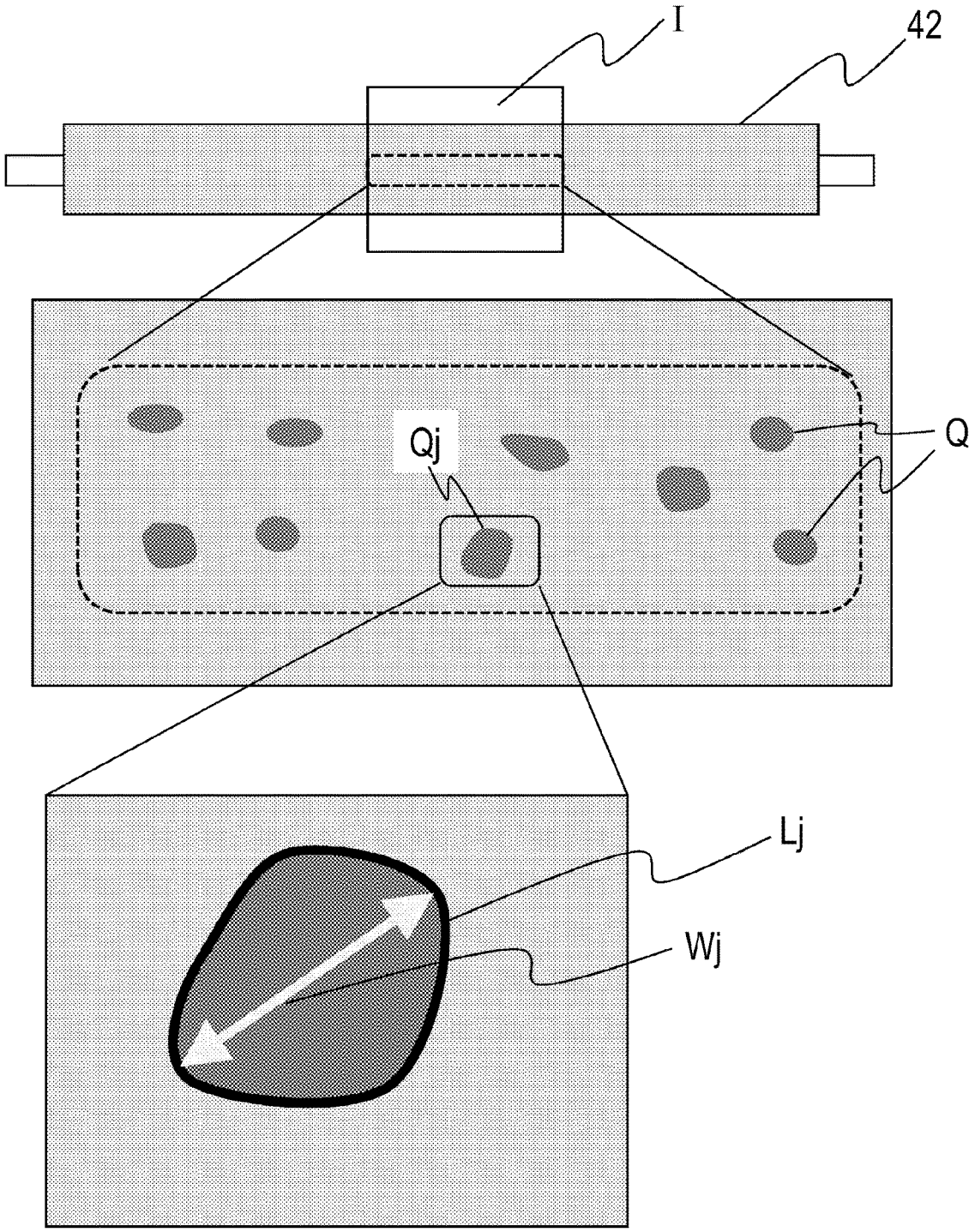
FIG. 10 is an enlarged diagram of a contact portion between a developing roller and a flat glass plate.

In the present invention, using a similar method to the measurement method of the contact area S described earlier, a width of a contact portion Q between a glass plate I and the particle portion 423*e* of the developing roller 42 when the glass plate I is brought into contact with a penetration level d with the developing roller 42 is adjusted so as to satisfy the following conditions. Specifically, as shown in FIG. 10, the particle portion 423*e* of the developing roller 42 is in contact with the glass plate I and forms a plurality of contact portions Qj made up of a plurality of isolated partial regions. In the plurality of contact portions Qj, among straight lines connecting any two points that oppose each other on an outer circumference Lj (on a contour line) that is a contour line of each contact portion Qj, a longest distance Wj is 40 μm or less. In this case, j denotes an individual number from 1 to the total number of contact portions in each contact portion in a field of view. By satisfying this condition, a white point attributable to fused matter can be suppressed.

Embodiment 6

Hereinafter, Embodiment 6 will be described. A basic configuration and operations of the image forming apparatus 100 according to the present embodiment are similar to those of the first embodiment. Therefore, elements having functions or configurations that are the same as or comparable to the image forming apparatus 100 according to the first embodiment will be denoted by same reference characters and a detailed description thereof will be omitted.

In the present embodiment, as described above, a scraping effect of discharge products on the photosensitive drum 1 is enhanced by having a portion with a large difference in height (a portion which protrudes toward the photosensitive drum 1 and which projects from the toner 90 layer: hereinafter, referred to as a scraping portion) on the surface of the developing roller 42 come into contact with the photosensitive drum 1 with a prescribed contact pressure or more without the toner 90 interposed therebetween.

The present embodiment enables more stable removal of discharge products by placing scraping efficiency in the contact region (nip portion) between the developing roller 42 and the photosensitive drum 1 in a preferable state. Specifically, a scraping index (a scraping coefficient) of the developing roller 42 is set to a prescribed value or more, the scraping index (the scraping coefficient) being calculated from the number of scraping portions on the surface of the developing roller 42 and a width in a circumferential direction of a surface region of the photosensitive drum 1 which is subjected to a scraping action by the scraping portions on the surface of the developing roller 42 at the contact portion between the developing roller 42 and the photosensitive drum 1.

Average Value T of Number of Scraping Portions

Figure 11:
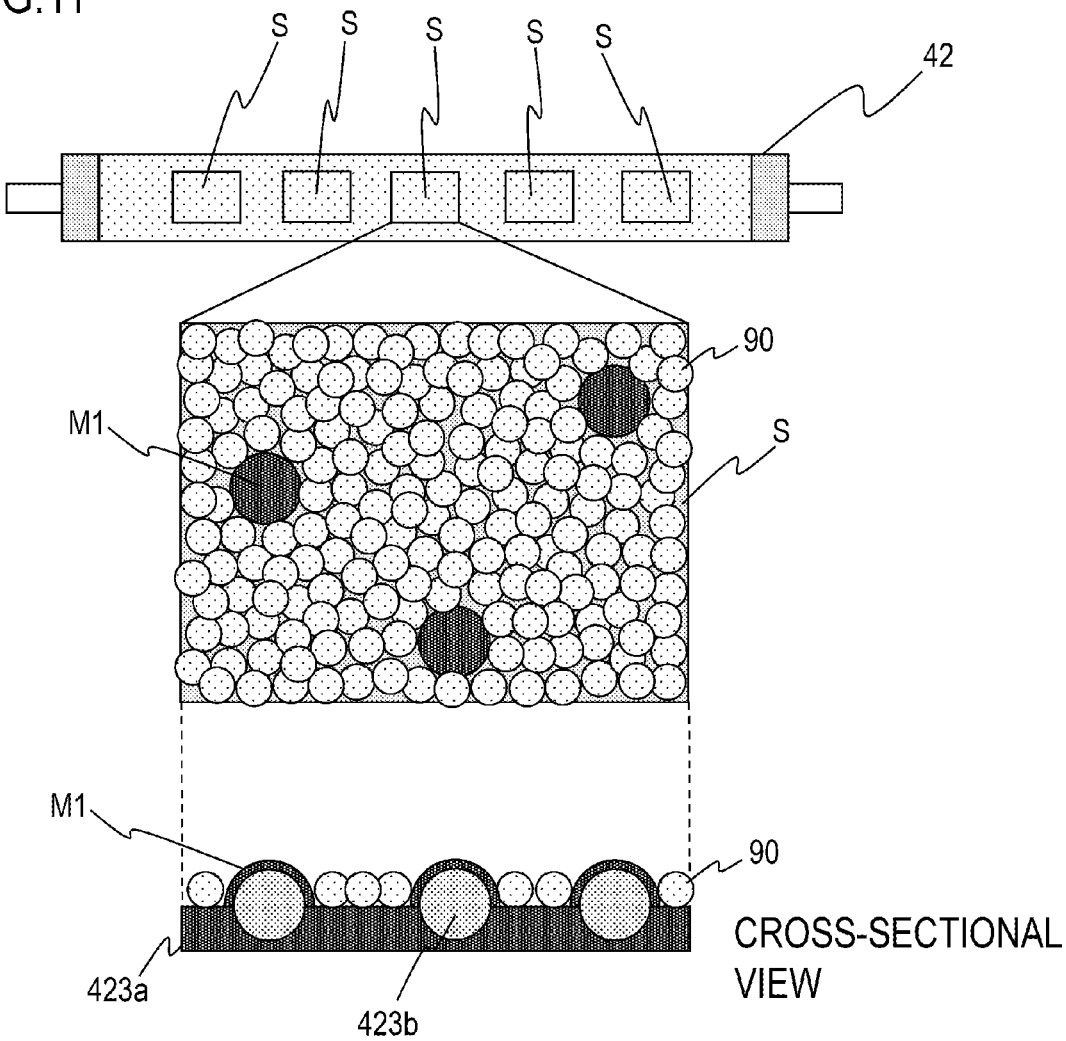
FIG. 11 is a diagram for describing a method of calculating the number of scraping portions on a developing roller surface according to Embodiment 6.

Hereinafter, a calculation method of the number of scraping portions on the surface of the developing roller 42 in Embodiment 6 according to the present invention will be described. FIG. 11 is a conceptual diagram that illustrates a calculation method of the number of scraping portions on the surface of the developing roller 42 according to the present embodiment.

First, the image forming apparatus 100 is forcibly stopped during an image forming operation to prepare the developing roller 42 in a state where the toner 90 layer is formed during the image forming operation.

Next, an objective lens with a magnification of 50 times is installed in a laser microscope VK-X200 (KEYENCE CORPORATION), and the surface of the developing roller 42 in a prescribed region S of 285 μm×210 μm is scanned two-dimensionally by a laser confocal optical system to obtain a high contrast image of the surface of the developing roller 42. An obtained image region is adopted as an evaluation object. In addition, in the image region (a second evaluation region), the number of portions M1 with a large difference in height (a portion which protrudes toward the photosensitive drum 1 and which projects from the toner 90 layer) on the surface of the developing roller 42 or, in other words, the number of scraping portions is measured. In the present embodiment, the number of scraping portions on the surface of the developing roller 42 is measured by making a visual count of the evaluation image. However, this method is not restrictive and a count utilizing image acquisition or image processing by other measurement apparatuses may be performed as long as the region on the surface of the developing roller 42 to be adopted as an elevation object is the same.

As a prescribed second evaluation region on the surface of the developing roller 42, a location where the process described above is performed is preferably provided in plurality at different positions in the longitudinal direction of the developing roller 42. In the present embodiment, the process described above was performed with respect to 10 points in the longitudinal direction of the developing roller 42 (one location each in 10 regions obtained by equally dividing the developing roller 42 in a rotational axis direction), and an arithmetic mean value thereof was adopted as an average value (an average number) T of the number of scraping portions on the surface of the developing roller 42. The larger the number of scraping portions on the surface of the developing roller 42, the higher the frequency of the discharge products on the photosensitive drum 1 being scraped off and, consequently, the higher the scraping efficiency.

Surface movement distance difference N in contact region

Hereinafter, a scraping action of the surface of the photosensitive drum 1 by the scraping portions on the surface of the developing roller 42 will be described with reference to the drawings. FIG. 12 is a conceptual diagram that illustrates a scraping action of the surface of the photosensitive drum 1 by the scraping portions on the surface of the developing roller 42.

Figure 12A:
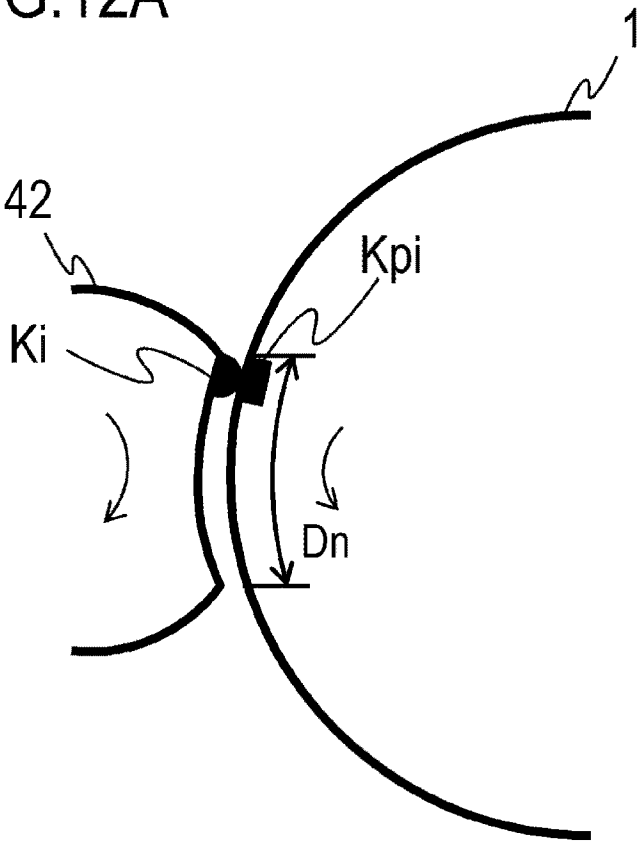
FIGS. 12A and 12B are diagrams for describing the scraping effect of a photosensitive drum surface by the scraping portion on the developing roller surface.
Figure 12B:
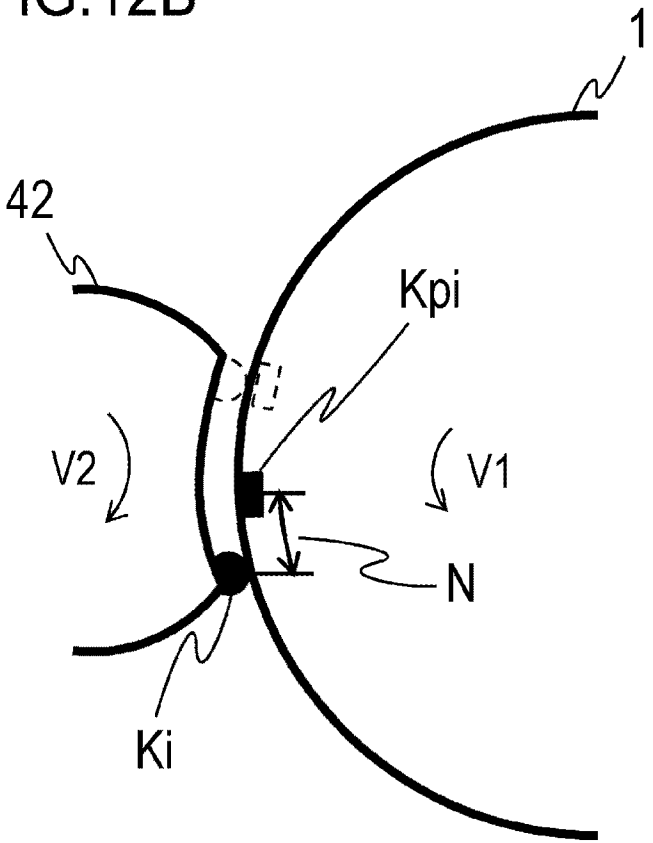

As shown in FIG. 12A, a surface of the photosensitive drum 1 which a single scraping portion Ki on the surface of the developing roller 42 opposes (comes into contact with) at the moment of entry to the contact region between the developing roller 42 and the photosensitive drum 1 is assumed to be a scraped portion Kpi. In the present invention, the developing roller 42 and the photosensitive drum 1 are rotationally driven by providing a prescribed surface movement speed ratio (hereinafter, referred to as a developing peripheral velocity ratio). Specifically, in the present embodiment, the developing roller 42 and the photosensitive drum 1 are rotationally driven so that a surface movement speed (a peripheral velocity) V2 of the developing roller 42 is higher than a surface movement speed V1 of the photosensitive drum 1. Therefore, as shown in FIG. 12B, at the moment when the scraping portion Ki exits the contact region between the developing roller 42 and the photosensitive drum 1, a surface movement distance difference N is generated in the contact region between the scraping portion Ki and the scraped portion Kpi due to a difference in the respective surface movement speeds.

On the surface of the photosensitive drum 1, a region corresponding to the surface movement distance difference N in the contact region becomes a region subjected to a scraping action by the scraping portions on the surface of the developing roller 42. The surface movement distance difference N in the contact region is represented by Expression 10 below.

$$N=(Vr-100)/100\times Dn \qquad \text{Expression 10}$$

In Expression 10, Vr denotes a developing peripheral velocity ratio % (Vr=V2/V1×100) and Dn denotes a width of the surface of the photosensitive drum 1 in a circumferential direction (a rotation direction) in the contact region between the developing roller 42 and the photosensitive drum 1. The greater the surface movement distance difference N in the contact region, the wider a scraping range on the surface of the photosensitive drum 1 by one scraping portion and, consequently, the higher the scraping efficiency.

Scraping Index Kh

In the present embodiment, the scraping index Kh (a first coefficient Kh) is calculated from the average value T of the number of scraping portions on the surface of the developing roller 42 and the surface movement distance difference N in the contact region between the developing roller 42 and the photosensitive drum 1 described above. The scraping index Kh is represented by Expression 11 below.

$$Kh=T\times N=T\times(Vr-100)/100\times Dn \qquad \text{Expression 11}$$

The scraping index Kh is an index represented by the number of scraping portions and a scraping range per one scraping portion. The larger the scraping index Kh, the wider an area of the surface of the photosensitive drum 1 subjected to a scraping action in the contact region between the developing roller 42 and the photosensitive drum 1 and, consequently, the higher the scraping efficiency.

Studies carried out by the present inventors revealed that the scraping index Kh of the developing roller 42 is preferably 0.12 or more. This is because, as described above, the wider an area of the surface of the photosensitive drum 1 subjected to a scraping action in the contact region between the developing roller 42 and the photosensitive drum 1, the higher the scraping efficiency of discharge products. Therefore, in the present embodiment, the scraping index Kh of the developing roller 42 is set to 0.12 or more.

Furthermore, studies carried out by the present inventors revealed that the average value T of the number of scraping portions on the surface of the developing roller 42 is more preferably 1.8/□ (where □ denotes an evaluation image size) or more. This is conceivably because the larger the number of scraping portions on the surface of the developing roller 42, the higher the frequency of the discharge products on the photosensitive drum 1 being scraped off and, consequently, the higher the scraping efficiency.

In addition, the developing peripheral velocity ratio is more preferably 135% or higher. This is because, when the developing peripheral velocity ratio is low, an amount of the toner 90 layer that is formed on the developing roller 42 in order to obtain appropriate image density must be increased, making it difficult for the scraping portions on the surface of the developing roller 42 to protrude from the toner 90 layer.

Details of Embodiment 6 and Comparative Example 6

Table 6 shows the average value T of the number of scraping portions, the developing peripheral velocity ratio Vr, the surface movement speed difference N in the contact region, the scraping index Kh, the drum contact pressure P, the contact area S, the contact portion pressure U, the modulus of elasticity A of the surface layer binder resin 423*a*, the modulus of elasticity B of the coarse particles 423*b*, and the modulus of elasticity R of the surface layer 423 of Embodiment 6 (6-1 to 6-7) which is the present embodiment and Comparative example 6 (6-1 to 6-4). In addition, Table 6 also shows evaluation results of image formation actually performed using the process cartridge 8 according to each Embodiment 6 and each Comparative example 6.

TABLE 6

| Configuration | Embodiment 6-1 | Embodiment 6-2 | Embodiment 6-3 | Embodiment 6-4 | Embodiment 6-5 | Embodiment 6-6 | Embodiment 6-7 |
|---|---|---|---|---|---|---|---|
| Average value T of number of scraping portions (number/□) | 1.2 | 1.8 | 2.6 | 1.8 | 1.8 | 2.6 | 3.2 |
| Developing peripheral velocity ratio Vr (%) | 135 | 120 | 111 | 135 | 160 | 135 | 140 |
| Surface movement speed difference N in contact region (mm) | 0.10 | 0.07 | 0.05 | 0.12 | 0.21 | 0.15 | 0.20 |
| Scraping index Kh | 0.12 | 0.12 | 0.12 | 0.22 | 0.37 | 0.40 | 0.65 |
| Drum contact pressure P (N/m) | 2.6 | 3.4 | 5.3 | 3.4 | 3.4 | 5.3 | 7.7 |
| Contact area S ($10^{-3}$ $mm^2$) | 0.8 | 1.0 | 1.3 | 1.0 | 1.0 | 1.3 | 1.7 |
| Contact portion pressure U ($N/mm^2$) | 8.9 | 8.9 | 8.9 | 8.9 | 8.9 | 8.9 | 8.9 |
| Modulus of elasticity A of surface layer binder resin (MPa) | 20 | 20 | 20 | 20 | 20 | 20 | 20 |
| Modulus of elasticity B of coarse particle (MPa) | 200 | 200 | 200 | 200 | 200 | 200 | 200 |
| Modulus of elasticity R of surface layer (MPa) | 94 | 94 | 94 | 94 | 94 | 94 | 94 |
| Image smearing evaluation result | ○Δ | ○Δ | ○Δ | ○ | ○ | ○ | ○ |

| Configuration | Comparative example 6-1 | Comparative example 6-2 | Comparative example 6-3 | Comparative example 6-4 |
|---|---|---|---|---|
| Average value T of number of scraping portions (number/□) | 0.7 | 1.2 | 1.8 | 3.2 |
| Developing peripheral velocity ratio Vr (%) | 160 | 120 | 111 | 140 |
| Surface movement speed difference N in contact region (mm) | 0.14 | 0.06 | 0.04 | 0.21 |
| Scraping index Kh | 0.10 | 0.07 | 0.07 | 0.66 |
| Drum contact pressure P (N/m) | 2.0 | 2.6 | 3.4 | 7.7 |
| Contact area S ($10^{-3}$ $mm^2$) | 0.6 | 0.8 | 1.0 | 5.0 |
| Contact portion pressure U ($N/mm^2$) | 8.9 | 8.9 | 8.9 | 3.0 |
| Modulus of elasticity A of surface layer binder resin (MPa) | 20 | 20 | 20 | 20 |

TABLE 6-continued

| | | | | |
|---|---|---|---|---|
| Modulus of elasticity B of coarse particle (MPa) | 200 | 200 | 200 | 10 |
| Modulus of elasticity R of surface layer (MPa) | 94 | 94 | 94 | 11 |
| Image smearing evaluation result | Δ | Δ | Δ | x |

Embodiments 6-1, 6-2, 6-3, 6-4, 6-5, 6-6, 6-7

Each of Embodiments 6-1 to 6-7 used the developing roller 42 of which the modulus of elasticity R of the surface layer 423 was 94 MPa. In addition, the drum contact pressure P in each embodiment is adjusted so as to attain a contact portion pressure U of 8.9 N/mm$^2$. Specifically, a thickness of the inter-shaft regulating member 45 according to each embodiment is varied and adjusted so as to attain a prescribed penetration level of d. In addition, in each of Embodiments 6-1 to 6-7, various conditions such as the average value T of the number of scraping portions and the developing peripheral velocity ratio Vr were provided so that the scraping index Kh of the developing roller 42 is 0.12 or more.

Specifically, in Embodiments 6-1 to 6-3, various conditions such as the average value T of the number of scraping portions and the developing peripheral velocity ratio Vr were provided so as to attain a scraping index Kh of the developing roller 42 of 0.12 or more. Embodiments 6-4 to 6-7 used the developing roller 42 in which the average value T of the number of scraping portions on the surface of the developing roller 42 was 1.8/1 or more. Furthermore, in Embodiments 6-4 to 6-7, the developing peripheral velocity ratio Vr is set to 135% or higher. Each developing roller 42 used in the present embodiment was fabricated by adjusting a use amount of the coarse particles 423*b* with respect to the surface layer binder resin 423*a*. As the coarse particles 423*b*, particles such as the urethane particle, the polystyrene particle, and the acrylic particle exemplified in Embodiments 3 to 5 may be used.

Comparative Examples 6-1, 6-2, 6-3, 6-4

Each of Comparative examples 6-1 to 6-3 used the developing roller 42 of which the modulus of elasticity R of the surface layer 423 was 94 MPa in a similar manner to Embodiment 6 (6-1 to 6-7). In addition, the drum contact pressure P is adjusted so as to attain contact portion pressure U of 8.9 N/mm$^2$. Specifically, a thickness of the inter-shaft regulating member 45 according to each comparative example is varied and adjusted so as to attain a prescribed penetration level of d.

In addition, in each of Comparative examples 6-1 to 6-3, various conditions such as the average value T of the number of scraping portions and the developing peripheral velocity ratio Vr were provided so as to attain a scraping index Kh of the developing roller 42 of less than 0.12.

On the other hand, Comparative example 6-4 used the developing roller 42 of which the modulus of elasticity R of the surface layer 423 was smaller than 50 MPa. In addition, the contact portion pressure U was adjusted to lower than 5.8 N/mm$^2$. However, in Comparative example 6-4, various conditions such as the average value T of the number of scraping portions and the developing peripheral velocity ratio Vr were provided so as to attain a scraping index Kh of the developing roller 42 of 0.12 or more.

Evaluation Method

To confirm the effect of the present embodiment, an evaluation of image smearing similar to that of Embodiment 1 was performed. However, in the evaluation according to the present embodiment, blurred characters in an output image during character image printing and line chipping in an output image during printing of a 2-dot, 3-space image (specifically, an image in which printing of 2 dot lines followed by non-printing of 3 dot lines are repetitively performed) were determined and evaluated visually according to the following criteria. A determination of x was made when a significant amount of blurred characters was generated and posed a problem in practical use, a determination of Δ was made when a small amount of blurred characters was generated but did not pose a problem in practical use, a determination of O was made when line chipping was present but no blurred characters were generated and did not pose a problem in practical use, and a determination of OΔ was made when neither line chipping nor blurred characters were generated. It should be noted that the evaluation of image smearing was verified after performing a paper-passing test of 4000 sheets with respect to both the embodiments and the comparative examples in an environment of a temperature of 30° C. and relative humidity of 80% in an untouched state where no paper had been passed for 12 hours or longer.

Comparison Between Embodiment 6 and Comparative Example 6

In the results of the evaluations of Embodiments 6-1 to 6-7 and Comparative examples 6-1 to 6-3 shown in Table 6, when the contact portion pressure U is 5.8 N/mm$^2$ or higher, a comparison among states where the contact portion pressure U is set more or less the same reveals a trend in that the larger the scraping index Kh of the developing roller 42, the less readily image smearing will be generated. This is because the wider an area of the surface of the photosensitive drum 1 subjected to a scraping action in the contact region between the developing roller 42 and the photosensitive drum 1, the higher the scraping efficiency of discharge products.

Therefore, as shown in Table 6, in order to further enhance the effect of suppressing image smearing, the scraping index Kh of the developing roller 42 is preferably 0.12 or higher as in Embodiments 6-1 to 6-7. In addition, in the results of the evaluations of Embodiments 6-1 and 6-4, a comparison among conditions in which the developing peripheral velocity ratio Vr is more or less the same reveals that the larger the average value T of the number of scraping portions on the surface of the developing roller 42, the greater the suppression of generation of image smearing.

This is conceivably because the larger the number of scraping portions on the surface of the developing roller 42, the higher the frequency of the discharge products on the photosensitive drum 1 being scraped off and, consequently, the higher the scraping efficiency. Therefore, as shown in Table 6, in order to further enhance the effect of suppressing image smearing, preferably, the average value T of the number of scraping portions on the surface of the developing roller 42 is 1.8/□ or more (the average number T in the second evaluation region is 1.8 or more).

In addition, in the results of the evaluations of Embodiments 6-2 and 6-4, a comparison among conditions in which the average value T of the number of scraping portions on the surface of the developing roller 42 is more or less the same reveals that the larger the developing peripheral velocity ratio Vr, the greater the suppression of generation of image smearing. This is because the larger the developing peripheral velocity ratio Vr, the greater the surface movement distance difference N in the contact region, the wider a scraping range on the surface of the photosensitive drum 1 by one scraping portion and, consequently, the higher the scraping effect. Therefore, as shown in Table 6, in order to further enhance the effect of suppressing image smearing, the developing peripheral velocity ratio Vr is preferably 135% or higher.

On the other hand, in Comparative example 6-4, a significant amount of blurred characters were generated due to image smearing and posed a problem in practical use. This is conceivably because the contact portion pressure U is lower than 5.8 N/mm$^2$. Specifically, when the contact portion pressure U is low and the scraping effect of the surface of the photosensitive drum 1 by the scraping portions is small, widening the scraping range does not make a large difference. As described above, the configuration according to the present embodiment enables generation of image smearing to be further suppressed with a simple configuration.

Embodiment 7

Hereinafter, Embodiment 7 will be described. A basic configuration and operations of the image forming apparatus 100 are similar to those of the first embodiment. Therefore, elements having functions or configurations that are the same as or comparable to the image forming apparatus 100 according to the first embodiment will be denoted by same reference characters and a detailed description thereof will be omitted.

Figure 13A:
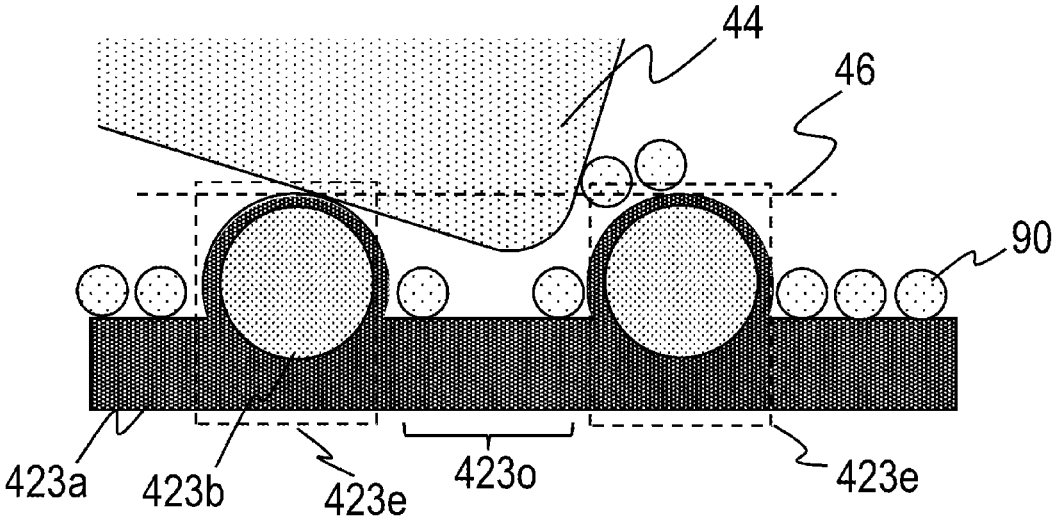
FIGS. 13A and 13B are schematic diagrams illustrating a contact state between a developing roller and a regulating blade according to Embodiment 7.

Embodiment 1 described earlier is configured such that the particle portion 423*e* of the developing roller 42 scrapes discharge products on the surface of the photosensitive drum 1 and suppresses generation of image smearing. However, when intervals of the particle portions 423*e* of the developing roller surface layer is widened in order to enhance scraping performance of discharge products in the particle portion 423*e*, a regulating force created by the regulating blade 44 acts on the layer of the toner 90 formed in regions between the plurality of particle portions 423*e* and variations in density of the toner are more readily generated (differences in a toner bearing amount are generated among the regions described above). In addition, depending on an arrangement of the regulating blade 44, as shown in FIG. 13A, the regulating blade 44 may penetrate into spaces between the surface layer particle portions 423*e* of the developing roller 42 to regulate the toner 90, and variations in density of the toner may be locally generated on the developing roller 42. When there are variations in density of the toner on the developing roller, roughness may appear in a solid image. When the developing roller 42 is viewed from a sectional direction, such variations in density of the toner are more readily prominently generated when a tip of the regulating blade 44 penetrates a base layer side of the developing roller 42 beyond a virtual line 46 connecting vertexes of adjacent particle portions 423*e*.

Figure 13B:
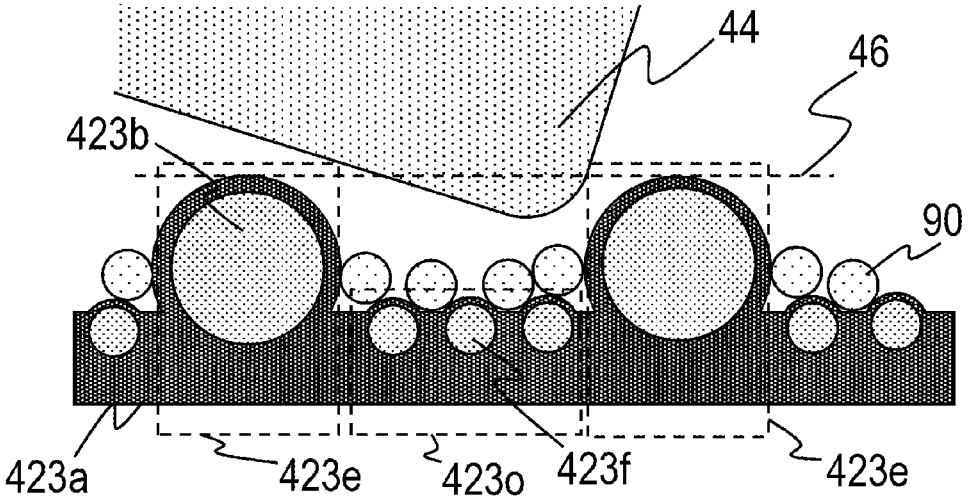

In consideration thereof, in the present embodiment, as shown in FIG. 13B, by providing irregularities between (hereinafter, referred to as a sea portion 423*o*) the plurality of particle portions 423*e* of the developing roller surface layer and setting roughness of this portion to a size sufficient for toner retention, even when the regulating blade 44 penetrates between the particle portions 423*e*, generation of roughness that is attributable to variations in density of the toner on the developing roller 42 is suppressed. In order to make a maximum height of roughness of the sea portion 423*o* lower than the developing roller surface layer particle portion 423*e* and to maintain scraping property of discharge products by the particle portion 423*e*, a volume-average particle diameter of the coarse particles 423*b* used in the particle portion 423*e* is set larger than a volume-average particle diameter of a small-diameter roughing particle 423*f* used in the sea portion 423*o*. In the present embodiment, particles with a volume-average particle diameter of 20 μm are used as the coarse particles 423*b* and particles with a volume-average particle diameter of 7 μm are used as the small roughing particles 423*f*. As materials of the coarse particles 423*b* and the small roughing particles 423*f*, particles such as the urethane particle, the polystyrene particle, and the acrylic particle exemplified in Embodiments 3 to 5 may be used.

Although there may be three or more types of roughing particles with different volume-average particle diameters or one type of a roughing particle with a broad volume-average particle diameter, two types of roughing particles are preferably used in order to satisfy both image smearing performance and a characteristic of suppressing a decline in roughness.

Furthermore, a configuration in which a tip (an edge) of the regulating blade 44 which is a regulating member is arranged so as to be penetrable into a region between two adjacent coarse particles 423*b* is desirable. In particular, a configuration in which the tip of the regulating blade 44 is arranged so as to penetrate into a side of the developing roller 42 beyond a tangent line connecting vertexes of two coarse particles 423*b* is more desirable (refer to FIG. 13). Because, by contacting the vertex of the particle portion 423*e* with the photosensitive drum 1, the scraping property of discharge products can be improved.

Surface Profile of Developing Roller

In the present embodiment, the developing roller 42 which satisfies both image smearing suppressing performance and roughness suppressing performance is defined by an element average length parameter RSm which represents intervals of the particle portions 423*e* of the developing roller surface layer and a core portion roughness Sk which represents roughness of the sea portion 423*o* of the developing roller surface layer. A detailed description will now be given.

In order to suppress image smearing, the contact portion pressure U of the surface layer of the developing roller 42 must be increased. One method to increase the contact portion pressure U is to reduce the number of particle portions 423*e*. Therefore, the image smearing suppressing performance is enhanced when the interval RSm of the particle portions 423*e* is large. On the other hand, when the regulating blade 44 penetrates between the particle portions 423*e*, a regulating force of the toner layer is generated. At this point, when a toner retaining force of the sea portion 423*o* is insufficient, a variation in density of the toner is generated. Since the regulating force acts as a force in the horizontal direction in FIG. 13, one method to increase the toner retaining force is to provide the sea portion 423*o* with irregularities. Accordingly, even when the regulating force in the horizontal direction in the diagram acts, toner can be retained by the irregularities in the sea portion 423*o* and generation of a variation in density of the toner can be suppressed.

When the interval RSm of the particle portions 423*e* is large, the regulating blade 44 more readily approaches the side of the base layer of the developing roller between the plurality of particle portions 423*e* and, since a stronger regulating force is generated, the core portion roughness Sk which represents roughness of the sea portion 423*o* may be set larger when the interval RSm of the particle portions 423*e* of the surface layer increases. However, although the core portion roughness Sk which represents roughness of the sea portion 423*o* increases when an amount of the small-diameter roughing particles 423*f* increases, when Sk becomes too large, toner is less readily replaced using the toner supplying roller 43. In the present embodiment, problems arise when Sk is equal to or larger than the volume-average particle diameter 7 μm of toner. In a similar manner, when the amount of the small-diameter roughing particles 423*f* increases, since a height of the sea portion 423*o* increases and the sea portion 423*o* ends up coming into contact with the photosensitive drum 1 in a similar manner to the particle portion 423*e* which is responsible for removing discharge products, the contact portion pressure U drops and image smearing suppressing performance declines.

Measurement Method of Surface Profile

A method of measuring a surface profile of the developing roller 42 and the interval RSm of the particle portions 423*e* will be described. For the surface profile measurement of the developing roller, an objective lens with a magnification of 20 times is mounted to a microscope VK-X200 manufactured by KEYENCE CORPORATION to set a viewing angle of 707×530 ($\mu m^2$). A prescribed region of the surface of the developing roller 42 which can be observed with this viewing angle corresponds to the first evaluation region according to the present invention. The developing roller 42 was arranged so as to align a long side 707 μm with the longitudinal direction of the developing roller 42 and a short side 530 μm with the circumferential direction of the developing roller 42. The surface of the developing roller 42 was set to brightness of 50 and a measurement was performed in a profile measurement mode.

Acquired data was processed according to the following procedure using a multiple file analysis application also manufactured by KEYENCE CORPORATION.

First, a planarization process of the developing roller 42 was performed. This was done to convert the developing roller 42 with an approximately cylindrical shape into a flat shape and to analyze. Next, the interval RSm of the particle portions 423*e* of the developing roller 42 was obtained by the following operation. A function built into the application described above was used to measure RSm. After setting a cutoff distance to 0.8 mm to remove long-wavelength waviness components, using a multiple surface roughness function, RSm was measured on 20 lines while aligning the measurement line in the longitudinal direction of the developing roller. Averages of 20 lines measurement values were adopted as the interval RSm of the particle portions 423*e* of the present embodiment and the comparative examples.

Figure 14:
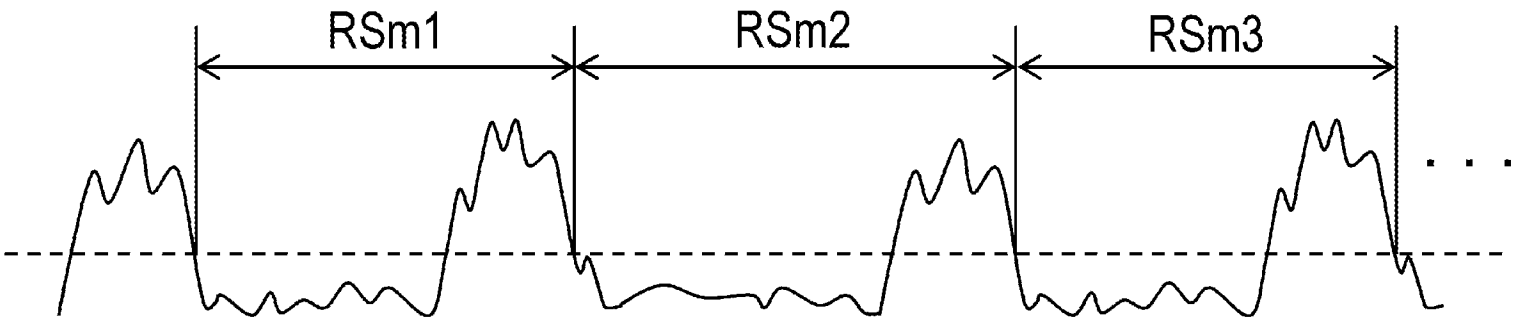
FIG. 14 is a diagram illustrating a definition of an element length RSm of a surface profile.

The significance of the measurement value RSm will now be described. A measurement method of RSm is defined in "Surface Roughness JIS B 0601". An outline will be provided below. As shown in FIG. 14, an average length of an element (RSm) represents an average of periods of roughness of a roughness curve. The average length of an element (RSm) indicates an average value of one period of a peak and a valley which constitute roughness with respect to a reference line of the roughness curve. However, those with heights equal to or less than 10% of a maximum height or lengths equal to or less than 1% of a calculation section are recognized as a part of a preceding or following peak and valley. In the surface layer 423 of the developing roller 42 used in the present embodiment, since the height of the particle portion 423*e* is higher than a height of the sea portion 423*o*, irregularities of the sea portion 423*o* are often equal to or less than 10% of the maximum height. Therefore, RSm is calculated around a height measurement value of the particle portion 423*e*. For this reason, the measurement value of RSm conceivably represents the interval of the particle portions 423*e*.

Next, methods of measuring the surface profile of the developing roller 42, roughness of the sea portion 423*o*, and a level difference Sk of a core portion will be described. Since a measurement method using a microscope is the same as that of the interval RSm of the particle portions 423*e*, a description will be omitted.

Acquired data was processed according to the following procedure using a multiple file analysis application also manufactured by KEYENCE CORPORATION.

First, a planarization process of the developing roller 42 was performed. This was done to convert the developing roller 42 with an approximately cylindrical shape into a flat shape. Next, a core portion level difference Sk which represents roughness of the sea portion 423*o* of the developing roller 42 was obtained by the following operation. A function built into the application described above was used to measure Sk. In order to extract a height of the sea portion 423*o* from the surface profile of the developing roller 42, a high-pass filter (hereinafter, described as HPF when necessary) with a cutoff distance of 25 μm was applied. Next, using a surface roughness measurement function, the core portion level difference Sk was measured with an entire region of a measurement field of view as an object region (the first evaluation region). Since the core portion level difference Sk was measured based on the height of the sea portion 423*o* extracted by a data computing process using a high-pass filter, the measurement value Sk was adopted as the roughness of the sea portion 423*o*.

Figure 15:
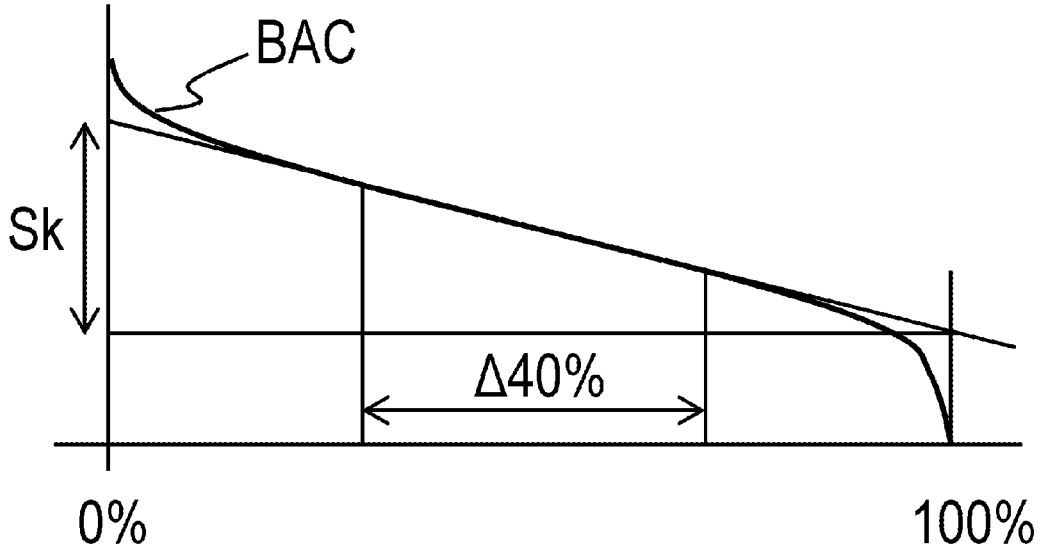
FIG. 15 is a diagram illustrating a definition of a core portion level difference Sk of a surface height.

The significance of the measurement value Sk will now be described. A measurement method of the core portion level difference Sk of a surface is defined in "ISO 25178: Geometric Product Specifications". An outline will be provided below. As shown in FIG. 15, a sequential cumulative measurement value of each measured surface height from highest (uppermost surface) to lowest (bottom of surface shape) is called a bearing area curve (BAC). An abscissa of the bearing area curve represents 0 to 100% and an ordinate represents height, with a 0% position being maximum height and a 100% position being minimum height. A measurement method of the level difference Sk of the core portion involves setting the level difference of the abscissa to 40% (ensuring that 40% of height probability of the surface is included) with respect to the bearing area curve and obtaining a least-squares line with respect to the bearing area curve at the 40% level difference. A least-squares line that minimizes the gradient is extrapolated and a difference in values of the line between bearing factors of 0% and 100% is referred to as the level difference Sk of the core portion.

It should be noted that, in a bearing area curve, a portion near maximum height is referred to as a protruded portion and a portion near minimum height is referred to as a valley portion. A space between a protruded portion and a valley portion is a core portion of roughness. Since the level difference Sk of the core portion is less likely to be affected by scratches and adhered objects of the surface, the level difference Sk of the core portion is preferable as an index representing a toner retention property.

Details of Embodiment 7 and Comparative Example 7

Table 7 shows the contact area S, the contact portion pressure U, the interval RSm of the particle portions 423*e*, and the core portion level difference Sk of surface roughness after a roughness high-pass filter, which is the roughness of the sea portion 423*o* of Embodiment 7 (7-1 to 7-10) which is the present embodiment and Comparative example 7 (7-1 to 7-3). In addition, Table 7 also shows evaluation results of image formation actually performed using the process cartridge 8 according to each embodiment and each comparative example. It should be noted that each Embodiment 7 and each Comparative example 7 commonly adopt a drum contact pressure P of 7.7 N/m, the modulus of elasticity A of the surface layer binder resin 423*a* of 50 MPa, the modulus of elasticity of the coarse particles 423*b* of 200 MPa, and the modulus of elasticity of the surface layer 423 of 167 MPa.

TABLE 7

| Configuration | Embodiment 7-1 | Embodiment 7-2 | Embodiment 7-3 | Embodiment 7-4 | Embodiment 7-5 | Embodiment 7-6 | Embodiment 7-7 | Embodiment 7-8 |
|---|---|---|---|---|---|---|---|---|
| Contact area S ($10^{-3}$ mm$^2$) | 1.0 | 1.2 | 1.2 | 1.6 | 1.7 | 2.5 | 1.0 | 1.2 |
| Contact portion pressure U (N/mm$^2$) | 28.8 | 12.1 | 12.7 | 9.2 | 9.0 | 6.0 | 27.4 | 13.0 |
| Roughness period RSm (μm) | 102 | 77 | 81 | 62 | 61 | 52 | 97 | 83 |
| Surface roughness core portion height Sk (μm) | 1.82 | 2.42 | 1.76 | 1.78 | 1.44 | 1.01 | 1.39 | 1.42 |
| Image smearing evaluation result | ○ | ○ | ○ | ○ | ○ | Δ | ○ | ○ |
| Image quality evaluation result solid black | ○ | ○ | ○ | ○ | ○ | ○ | Δ | ○ |

| Configuration | Embodiment 7-9 | Embodiment 7-10 | Comparative example 7-1 | Comparative example 7-2 | Comparative example 7-3 |
|---|---|---|---|---|---|
| Contact area S ($10^{-3}$ mm$^2$) | 1.2 | 1.7 | 1.0 | 2.5 | 3.0 |
| Contact portion pressure U (N/mm$^2$) | 12.6 | 9.0 | 14.8 | 5.9 | 5.1 |
| Roughness period RSm (μm) | 80 | 61 | 98 | 51 | 39 |
| Surface roughness core portion height Sk (μm) | 1.03 | 0.95 | 0.62 | 0.64 | 1.83 |
| Image smearing evaluation result | ○ | ○ | ○ | Δ | x |
| Image quality evaluation result solid black | Δ | Δ | x | x | ○ |

Embodiments 7-1, 7-2, 7-3, . . . , 7-10

In each of Embodiments 7-1 to 7-10, contact portion pressure is set to 5.8 N/mm$^2$ or higher so that discharge products on the photosensitive drum 1 can be readily scraped off. The moduli of elasticity of the surface layer binder resin 423*a* and the coarse particles 423*b* used were those of Embodiment 1-2 in order to set a high modulus of elasticity of the surface layer of 167 MPa or higher. In addition, in order to add toner retention property in the sea portion 423*o*, a combination of the coarse particles 423*b* and the small-diameter roughing particle 423*f* was used in the surface layer 423. The interval of the particle portions 423*e* was set within a range of about 40 μm to RSm 100 μm, and post-HPF Sk representing sea portion roughness was 0.95 μm to 2.42 μm. Mixture amounts of the coarse particles 423*b* and the small-diameter roughing particles 423*f* were adjusted in order to obtain such characteristics of the surface layer 423.

Comparative Examples 7-1, 7-2, 7-3

The surface layer 423 of the developing roller 42 according to Comparative examples 7-1 to 7-3 will now be described. Since a configuration of the developing roller 42 with the exception of the surface layer 423 is more or less the same as that of Embodiment 7, a description thereof will be omitted below. As shown in Table 7, in Comparative examples 7-1 to 7-3, although the interval of the particle portions 423*e* ranges from 40 to 100 μm in a similar manner to Embodiments 7-1 to 7-10, post-HPF Sk was reduced by either not using the small-diameter roughing particles 423*f* or reducing a mixture amount of the small-diameter roughing particles 423*f* with respect to Embodiments 7-1 to 7-10. The mixture amounts of the coarse particles 423*b* and the small-diameter roughing particles 423*f* were adjusted in order to obtain such characteristics of the surface layer 423.

Evaluation Method

An evaluation method of image roughness which is an effect of the present embodiment will now be described. A position of the regulating blade 44 relative to the developing roller 42 was adjusted so that a toner amount on the developing roller 42 after passage of the regulating blade 44 ranged from 0.3 to 0.33 mg/cm$^2$, and after performing a paper-passing test of 4000 sheets in each embodiment and each comparative example, a solid black image was output in an untouched state where no paper had been passed for 12 hours or longer. Roughness of the output solid black image was visually evaluated, and a determination of O was made when there were no problems, a determination of Δ was made when there was slight roughness, and a determination of x was made when there was significant roughness.

Comparison Between Embodiment 7 and Comparative Example 7

Among Table 7, with respect to Embodiment 7-1, Embodiment 7-7, and Comparative example 7-1 of which the value of RSm of approximately 100 μm was more or less the same, no roughness was observed in Embodiment 7-1 of which post-HPF Sk was 1.82 μm, roughness was observed but did not pose a problem in practical use in Embodiment 7-7 of which post-HPF Sk was 1.39 μm, but roughness was observed in Comparative example 7-1 of which post-HPF Sk was 0.62 μm.

In addition, with RSm of approximately 50 μm, no roughness was observed in Embodiment 7-6 of which post-HPF Sk was 1.01 μm but roughness was observed in Comparative example 7-2 of which post-HPF Sk was 0.62 μm. Furthermore, as collectively shown in Embodiments 7-2 to 7-5 and Embodiments 7-8 to 7-10 with RSm ranging from about 60 μm to 80 μm, the larger the interval RSm of the particle portions 423*e*, the larger the value of post-HPF Sk which represents small particle portion roughness, which means less roughness is visible.

In order to satisfy both image smearing and roughness, both the interval RSm of the particle portions 423*e* and roughness post-HPF Sk of the sea portion 423*o* are preferably large, and image smearing and roughness are both satisfied without posing a problem in practical use when the interval RSm of the particle portions 423*e* is 50 μm or more and roughness post-HPF Sk of the sea portion 423*o* is 0.95 μm or more. In particular, in order to satisfy both image smearing and roughness at favorable levels, RSm is preferably 60 μm or more and post-HPF Sk is preferably 1.4 μm or more. It should be noted that when RSm was 40 μm or less as shown in Comparative example 7-3, image smearing was generated due to a narrower interval of the contact portions and an increase in size of the contact area S.

Operational Effect

A direction in which the interval RSm of the particle portions 423*e* of the developing roller surface layer is widened is a direction in which image smearing is further suppressed by increasing the contact portion pressure U. This is conceivably because, when the interval RSm of the particle portions 423*e* increases, a regulating force more readily acts on toner on the side of the developing roller surface layer via toner in proximity to the regulating blade 44. Furthermore, the wider the interval RSm of the particle portions 423*e*, the more readily the regulating blade 44 penetrates between the particle portions 423*e*, thereby increasing a force of scraping off a layer of toner from the developing roller surface and causing a variation in density of the toner to be more readily generated.

When there are irregularities capable of retaining toner in the sea portion 423*o* of the developing roller surface layer, the toner can be more readily retained by the irregularities even when a regulating force acts and roughness attributable to a variation in density of the toner is less readily generated. With respect to toner with a volume-average particle diameter of 7 μm, the toner retaining force of the sea portion 423*o* is exhibited in a range of roughness post-HPF Sk of the sea portion 423*o* of 0.95 μm or more. When RSm is large, by further increasing post-HPF Sk and increasing the toner retaining force, the toner can be retained and generation of roughness can be suppressed.

Roughness is sometimes generated when using a developing roller equipped with a function of suppressing generation of image smearing. With the configuration according to the present embodiment, generation of roughness can be suppressed while also suppressing generation of image smearing with a simple configuration without hampering convenience of a user.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-079338, filed on Apr. 18, 2019, and No. 2020-054720, filed on Mar. 25, 2020, which are hereby incorporated by reference herein in its entirety.

What is claimed is:

1. A developer bearing member including:

a rotational shaft; and an elastic layer formed on an outer circumference surface of the rotational shaft, developer being borne on a surface of the elastic layer, wherein the elastic layer is configured such that, a load per unit area of a contact portion between one surface of a flat glass plate and the surface of the elastic layer is to be 5.8 N/mm$^2$ or more, in a state that the one surface of the flat glass plate being parallel with an axis direction of the rotational shaft and the one surface of the flat glass plate coming into contact with the surface of the elastic layer with a predetermined penetration level, and wherein a ten-point average roughness Rzjis on the surface of the elastic layer is greater than a volume-average particle diameter of a particle of the developer.

2. The developer bearing member according to claim 1, wherein the contact portion includes a plurality of isolated partial regions, and wherein, among straight lines connecting any two points on a contour line of the partial region, a longest distance between two points is 40 μm or less.

3. The developer bearing member according to claim 1,
wherein the surface of the elastic layer includes a plurality of protrusions, and
wherein the contact portion is formed between the protrusion and the flat glass plate.

4. A process cartridge comprising:
the developer bearing member according to claim 3, and
an image bearing member for bearing an image,
wherein the process cartridge is detachably attached to a main body of an image forming apparatus.

5. The process cartridge according to claim 4,
wherein, the image bearing member is rotated at a different peripheral velocity from a peripheral velocity of the developer bearing member, and
wherein, during an image formation for forming an image, when a plurality of predetermined regions are defined as second evaluation regions and are set at different positions on a surface of the developer bearing member in a longitudinal direction of the developer bearing member,
an average number of the protrusions projected from the developer layer within the second evaluation regions is T,
a ratio of a peripheral velocity of the developer bearing member to a peripheral velocity of the image bearing member is Vr, and
a width of a nip portion formed by the image baring member and developer bearing member in a rotational direction of the image bearing member is Dn,
a first coefficient Kh related to the developer bearing member is represented by a following Equation 2, $$Kh=T\times(Vr-100)/100\times Dn, \text{ and} \qquad \text{Equation 2:}$$

Kh is 0.12 or more.

6. The process cartridge according to claim 5,
wherein the elastic layer includes a surface layer forming the surface of the elastic layer and a base layer supporting the surface layer, and
wherein the surface layer includes:
a binder resin; and
a coarse member distributed in the binder resin.

7. The process cartridge according to claim 6,
wherein, in the contact portion, when a ratio of a thickness of the coarse member to a thickness of the binder resin in a direction perpendicular to an axial direction of the developer bearing member is "e", a compressive elastic modulus of the binder resin is "A", and a compressive elastic modulus of the coarse member is "B",
an elastic modulus R of the surface layer is represented by a following Equation 1, $$R=(1+e)/(1/A+e/B), \text{ and} \qquad \text{Equation 1:}$$

R is 50 MPa or more.

8. The process cartridge according to claim 6,
wherein the coarse member is composed of a coarse particle, and
wherein the protrusion is formed by the coarse particle.

9. The process cartridge according to claim 5,
wherein, when the second evaluation region is set as a rectangular region of 285 μm×210 μm,
T in the second evaluation region is 1.8 or more.

10. The process cartridge according to claim 5,
wherein, Vr is 135% or more.

11. The developer bearing member to claim 3,
wherein, when the developer bearing member is used with an image bearing member, and the developer bearing member contacts with the image bearing member with the predetermined penetration level of the flat glass plate, a load per unit length of the surface of the elastic layer against the image bearing member in an axial direction of the developer bearing member is 20 N/m or less.

12. The developer bearing member according to claim 1,
wherein the elastic layer includes a surface layer forming the surface of the elastic layer and a base layer supporting the surface layer, and
wherein the surface layer includes:
a binder resin; and
a coarse member distributed in the binder resin.

13. The developer bearing member according to claim 12,
wherein, in the contact portion, when a ratio of a thickness of the coarse member to a thickness of the binder resin in a direction perpendicular to an axial direction of the developer bearing member is "e", a compressive elastic modulus of the binder resin is "A", and a compressive elastic modulus of the coarse member is "B",
an elastic modulus R of the surface layer is represented by a following Equation 1, $$R=(1+e)/(1/A+e/B), \text{ and} \qquad \text{Equation 1:}$$

R is 50 MPa or more.

14. The developer bearing member to claim 12,
wherein the coarse member includes a first coarse particle having a first volume-average particle diameter and a second coarse particle having a second volume-average particle diameter smaller than the first volume-average particle diameter.

15. The developer bearing member to claim 14,
wherein the coarse particle includes at least one among an urethane particle, a polystyrene particle, and an acrylic particle.

16. The developer bearing member to claim 15,
wherein a silica particle is adhered to a surface of the urethane particle.

17. A process cartridge comprising:
the developer bearing member according to claim 1, and
an image bearing member for bearing an image,
wherein the process cartridge is detachably attached to a main body of an image forming apparatus.

18. The process cartridge according to claim 17,
wherein the image bearing member is rotated at a different peripheral velocity from a peripheral velocity of the developer bearing member.

19. The process cartridge according to claim 17,
wherein the developer bearing member is provided so as to contact with the image bearing member with the predetermined penetration level.

20. An image forming apparatus comprising:
the developer bearing member according to claim 1; and
a transfer member,
wherein the developer bearing member is provided so as to contact with an image bearing member for bearing an image with the predetermined penetration level.

21. The developer bearing member to claim 1,
wherein, when the developer bearing member is used with an image bearing member, and the developer bearing member contacts with the image bearing member with the predetermined penetration level of the flat glass plate, a load per unit length of the surface of the elastic layer against the image bearing member in an axial direction of the developer bearing member is 20 N/m or less.

22. A developing apparatus comprising:

a developer bearing member for supplying developer to an image bearing member for bearing an image; and a regulating member for regulating a thickness of the developer borne by the developer bearing member, the developer bearing member including:

a rotational shaft; and an elastic layer formed on an outer circumference surface of the rotational shaft, developer being borne on a surface of the elastic layer, wherein the elastic layer is configured such that, a load per unit area of a contact portion between one surface of a flat glass plate and the surface of the elastic layer is to be 5.8 $N/mm^2$ or more, in a state that the one surface of the flat glass plate being parallel with an axis direction of the rotational shaft and the one surface of the flat glass plate coming into contact with the surface of the elastic layer with a predetermined penetration level, and wherein a ten-point average roughness Rzjis on the surface of the elastic layer is greater than a volume-average particle diameter of a particle of the developer.

23. The developing apparatus according to claim 22, wherein when a predetermine region on the surface of the elastic layer is defined as a first evaluation region, and when, in the first evaluation region, an average length of a surface roughness of the elastic layer is "RSm", and a core portion level difference, which is obtained from a roughness of the surface of the elastic layer by a data computing process using a high-pass filter with a cutoff distance of 25 μm, is "SK", "SK" is 0.95 μm or more when "RSm" is 50 μm or more.

24. The developing apparatus according to claim 23, wherein "SK" is 1.4 μm or more when "RSm" is 60 μm or more.

25. The developing apparatus according to claim 22, wherein, when the developer bearing member contacts with the image bearing member with the predetermined penetration level of the flat glass plate, a load per unit length of the surface of the elastic layer against the image bearing member in an axial direction of the developer bearing member is 20 N/m or less.

26. The developing apparatus according to claim 22, wherein the developer bearing member and the regulating member are configured to be applied with a voltage respectively, and wherein the developer bearing member and the regulating member are configured such that a potential difference between the developer bearing member and the regulating member has a polarity same as a charging polarity of the developer, the potential difference being obtained by subtracting a voltage of the developer bearing member from a voltage of the regulating member.

27. The developing apparatus according to claim 22, wherein the elastic layer includes a surface layer forming the surface of the elastic layer and a base layer supporting the surface layer, and wherein the surface layer includes:

a binder resin and a coarse member distributed in the binder resin, and wherein the coarse member has an exposed portion exposed from the binder resin, and when the regulating member and an exposed portion of the coarse member are rubbed with each other, a charging polarity of a surface of the exposed portion has a polarity same as the charging polarity of the developer.

28. The developing apparatus according to claim 22, wherein the developer remaining on the image bearing member after image formation is collected by the developer bearing member.

29. The developing apparatus according to claim 22, wherein the developing apparatus is detachably attached to a main body of an image forming apparatus.

* * * * *